US008687838B2

(12) United States Patent
Mitsui et al.

(10) Patent No.: US 8,687,838 B2
(45) Date of Patent: Apr. 1, 2014

(54) SPEAKER UNIT

(75) Inventors: Akihito Mitsui, Yokohama (JP); Shinichi Yamada, Yokohama (JP)

(73) Assignee: Mitsubishi Pencil Company, Limited, Tokyo (JP)

( * ) Notice: Subject to any disclaimer, the term of this patent is extended or adjusted under 35 U.S.C. 154(b) by 210 days.

(21) Appl. No.: 13/255,754

(22) PCT Filed: Mar. 10, 2010

(86) PCT No.: PCT/JP2010/054005

§ 371 (c)(1), (2), (4) Date: Oct. 17, 2011

(87) PCT Pub. No.: WO2010/104112

PCT Pub. Date: Sep. 16, 2010

(65) Prior Publication Data

US 2012/0033837 A1 Feb. 9, 2012

(30) Foreign Application Priority Data

Mar. 11, 2009 (JP) ..... 2009-057901
Apr. 30, 2009 (JP) ..... 2009-111539

(51) Int. Cl.
*H04R 1/00* (2006.01)

(52) U.S. Cl.
USPC ..... 381/401; 381/400

(58) Field of Classification Search
USPC ..... 381/423, 426, 431, 191; 181/148, 157, 181/167–170, 173
See application file for complete search history.

(56) References Cited

U.S. PATENT DOCUMENTS

| | | | | |
|---|---|---|---|---|
| 4,566,120 | A * | 1/1986 | Nieuwendijk et al. | 381/117 |
| 7,376,239 | B2 * | 5/2008 | Kirjavainen | 381/414 |
| 7,548,632 | B2 * | 6/2009 | Fukuyama et al. | 381/429 |
| 8,144,918 | B2 * | 3/2012 | Ikeda et al. | 381/423 |
| 8,306,244 | B2 * | 11/2012 | Okamura et al. | 381/111 |
| 2008/0260188 | A1 * | 10/2008 | Kim | 381/190 |
| 2009/0110217 | A1 | 4/2009 | Yasuda et al. | |

FOREIGN PATENT DOCUMENTS

| | | | |
|---|---|---|---|
| JP | 61-206397 | A | 9/1986 |
| JP | 62-141898 | A | 6/1987 |
| JP | 1-126900 | A | 5/1989 |
| JP | 4-326291 | A | 11/1992 |
| JP | 2004-032425 | A | 1/2004 |
| JP | 2009-049686 | A | 3/2009 |
| WO | 2007/135928 | A1 | 11/2007 |

OTHER PUBLICATIONS

International Search Report of PCT/JP2010/054005, mailing date Apr. 20, 2010.

* cited by examiner

*Primary Examiner* — Brian Ensey
(74) *Attorney, Agent, or Firm* — Westerman, Hattori, Daniels & Adrian, LLP

(57) ABSTRACT

A speaker unit is realized which directly drives a vibration plate having a low density, light weight, yet sufficient rigidity with a digital audio signal, and can thereby transmit vibration of a voice coil thereof to a carbonaceous acoustic vibration plate without loss. The present invention provides a digital speaker unit including a speaker body (14) comprising a carbonaceous acoustic vibration plate (25), a delta-sigma modulator (11) and a thermometer code conversion section (12) that convert a multi-value bit digital audio signal supplied from a digital sound source (10) to a digital signal with required bits, a plurality of voice coils (24) that cause to vibrate a plurality of the carbonaceous acoustic vibration plates (25) provided in accordance with the number of digital signal bits and a driver circuit (13) that individually drives each voice coil (24) based on the digital signal.

12 Claims, 15 Drawing Sheets

SPEAKER UNIT

TECHNICAL FIELD

The present invention relates to a speaker unit for sound reproduction, and more particularly, to a speaker unit directly driven by a digital audio signal.

BACKGROUND ART

Conventionally, digital speakers are being developed which reproduce a digital audio signal not by converting it to an analog signal but directly supplying it to a speaker (e.g., see Patent Literature 1). The digital speaker described in Patent Literature 1 assigns weights to a plurality of voice coils wound around a voice coil bobbin respectively so that a drive force corresponding to each bit of the digital signal is generated, the polarity of a certain voltage applied to each voice coil is changed according to the binary value of the respective two bits of the digital signal and the direction of a current flowing through the voice coil is thereby set according to the binary value. This configuration allows a drive force to be generated at a ratio corresponding to quantization of the digital signal.

Furthermore, speaker units are being proposed which apply a digital/analog conversion apparatus that generates an analog signal of high quality from a digital signal to a drive apparatus of a digital speaker to thereby improve quality of reproduced sound and realize circuit scale reduction (e.g., see Patent Literature 2). The speaker unit described in Patent Literature 2 converts an n-bit output of a delta-sigma modulator to a thermometer code through a formatter, performs mismatch shaping processing using a post filter, inputs the output to a buffer circuit, controls a coil with the digital signal outputted from the buffer circuit and adds a magnetic field thereto (see paragraphs 0063 and 0078).

On the other hand, vibration plates of speakers used for mobile devices such as acoustic devices, video equipment and mobile phones are required to have the ability to accurately reproduce clear sound in a wide frequency band, and a high frequency range in particular. Therefore, the material of the vibration plate is required to have a high elastic modulus so as to give sufficient rigidity to the vibration plate and a low density so as to reduce the weight of the vibration plate, which are apparently mutually contradictory characteristics. Especially vibration plates for digital speakers which are becoming a focus of attention in recent years are strongly required to satisfy these characteristics from the standpoint of requirements for vibration response.

CITATION LIST

Patent Literature

Patent Literature 1: Japanese Patent Application Laid-Open No. 4-326291

Patent Literature 2: Pamphlet of International Publication No. 2007/135928

SUMMARY OF INVENTION

Technical Problem

It is therefore an object of the present invention to provide a speaker unit capable of directly driving a vibration plate having a low density, light weight, yet sufficient rigidity with a digital audio signal and transmitting vibration of a voice coil to a carbonaceous acoustic vibration plate, thus realizing excellent acoustic characteristics.

Solution to Problem

A speaker unit according to the present invention includes a carbonaceous acoustic vibration plate, a voice coil made up of a cylindrically wound conductive wire, one open end portion of which is fixed in direct contact with the carbonaceous acoustic vibration plate, magnetic flux generating section configured to generate a magnetic flux that penetrates the cylindrical voice coil in a diameter direction, and drive section configured to supply a drive current corresponding to an audio signal to the voice coil.

Since this configuration adopts a structure in which one end portion of the voice coil directly contacts the carbonaceous acoustic vibration plate, vibration excited by the voice coil in response to the audio signal is transmitted to the carbonaceous acoustic vibration plate without loss. Since the vibration of the voice coil can be transmitted to the carbonaceous acoustic vibration plate efficiently, it is possible to realize a speaker capable of outputting a sound that accurately reproduces the audio signal.

Furthermore, in the above-described speaker unit of the present invention, the voice coil is made up of a plurality of unit voice coils corresponding to the number of bits of the digital signal configured by making the plurality of unit voice coils have different diameters and sequentially inserting the unit voice coils such that a unit voice coil of a smaller diameter is inserted into a unit voice coil of a greater diameter and the drive section individually drives the each unit voice coil based on each bit value of the digital signal.

According to this configuration, the speaker body comprising the carbonaceous acoustic vibration plate is directly driven with a digital signal, and it is thereby possible to realize excellent acoustic characteristics by taking advantage of characteristics of the carbonaceous acoustic vibration plate which has a low density, light weight yet sufficient rigidity.

Furthermore, in the above-described speaker unit of the present invention, the each unit voice coil is configured by cylindrically winding a conductive wire having an oblong cross section such that wires neighboring each other in a direction orthogonal to the coil diameter direction are in close contact with each other in the major axis direction of the wire cross section.

According to this configuration, even when a plurality of unit voice coils are multilayered in the diameter direction, it is possible to suppress the coil thickness (one layer or multilayer) in the coil diameter direction of the voice coil as a whole, narrow the gap in which the voice coil is arranged so as to allow a magnetic flux to penetrate the voice coil and reduce magnetic loss.

Furthermore, in the above-described speaker unit of the present invention, the each unit voice coil is configured by cylindrically winding a conductive wire having an oblong cross section such that wires neighboring each other in a direction orthogonal to the coil diameter direction are in close contact with each other in the minor axis direction of the wire cross section.

According to this configuration, since the conductive wire making up the unit voice coil is configured such that the neighboring wires contact each other densely in the minor axis direction of wire cross section, it is possible to further suppress loss when transmitting vibration excited by the voice coil to the carbonaceous acoustic vibration plate.

Furthermore, in the above-described speaker unit of the present invention, the carbonaceous acoustic vibration plate has a first principal surface to which an open end portion of the voice coil is fixed and a second principal surface opposite to the first principal surface, and the voice coil is arranged so that an outermost circumference position of the open end portion is located at a position deviated inward from the vibration plate outer circumferential edge and one end portion of a support member that supports the carbonaceous acoustic vibration plate in a vibratable manner on the vibration plate outer circumferential edge which is on the second principal surface and does not overlap the fixed position of the open end portion of the voice coil.

According to this configuration, since one end portion of the support member which supports the carbonaceous acoustic vibration plate is fixed on the vibration plate outer circumferential edge that does not overlap with the voice coil fixed position in a vibratable manner, it is possible to allow the support member to directly absorb the vibration given by the voice coil to the carbonaceous acoustic vibration plate, thereby avoid a problem that the carbonaceous acoustic vibration plate becomes inflexible, and reduce deterioration of vibration characteristics of the carbonaceous acoustic vibration plate to a minimum.

Furthermore, in the above-described speaker unit of the present invention, the magnetic flux generating section includes a yoke having an end portion facing an outer circumferential surface of the voice coil fixed to the carbonaceous acoustic vibration plate, a centerpiece, inserted into the coil from the other open end portion of the voice coil, that forms a gap between opposed end portions of the yoke and itself, and a permanent magnet located between the centerpiece and the yoke, one magnetic pole of which is faced on the centerpiece side and the other magnetic pole of which is faced on the yoke side, and the carbonaceous acoustic vibration plate has a first principal surface to which an open end portion of the voice coil is fixed, a second principal surface provided opposite to the first principal surface and a convex portion formed at a position at which the open end portion of the voice coil is fixed on the first principal surface wherein the convex portion has a height that a central portion of the voice coil becomes a gap position between the end portion of the yoke and the centerpiece.

According to this configuration, the voice coil is arranged so that its central portion is located at the gap position, which maximizes the number of magnetic fluxes that cross the voice coil and maximizes the force by a current flow through the voice coil. That is, it is possible to vibrate the carbonaceous acoustic vibration plate most efficiently.

In the speaker unit, lead positions of lead wires connected to the respective unit voice coils are preferably distributed uniformly on the outer circumference of the carbonaceous acoustic vibration plate. Since the tension of the lead wires drawn from the unit voice coils has a large influence on the vibration characteristics of the carbonaceous acoustic vibration plate, uniformly distributing the lead positions of the lead wires at locations on the outer circumference of the carbonaceous acoustic vibration plate makes it possible to realize a lead structure that will not deteriorate the vibration characteristics of the carbonaceous acoustic vibration plate.

In the above-described speaker unit of the present invention, the drive section includes a delta-sigma modulator that delta-sigma modulates a multi-value bit digital audio signal supplied from a digital sound source and individually drives the each voice coil based on the digital signal outputted from the delta-sigma modulator.

According to this configuration, the using of the delta-sigma modulator makes it possible to eliminate, through a noise shaping effect, quantization noise produced in the process of converting a multi-value bit digital audio signal supplied from the digital sound source to a digital signal with required bits and reduce quantization errors using an oversampling method.

Furthermore, in the above-described speaker unit of the present invention, the drive section includes a thermometer code conversion section configured to convert a digital signal with predetermined bits outputted from the delta-sigma modulator to a thermometer code with bits corresponding to the number of the voice coils.

According to this configuration, since a binary number outputted from the delta-sigma modulator is a signal, each bit of which is weighted, it is difficult to perform direct drive in digital using the signal as is, but by converting the signal to a thermometer code, each bit of which is not weighted, it is possible to drive directly the speaker body with a digital signal.

In the above-described speaker unit, the carbonaceous acoustic vibration plate may be made of a porous material containing amorphous carbon and carbon powder uniformly dispersed in the amorphous carbon and having a porosity of 40% or above.

Furthermore, in the above-described speaker unit, the carbonaceous acoustic vibration plate may also be configured to include a low-density layer containing amorphous carbon and carbon powder uniformly dispersed in the amorphous carbon and made of a porous material having a porosity of 40% or above, and a high-density layer which contains amorphous carbon, is thinner than the low-density layer and has a higher density than the low-density layer.

In the above-described speaker unit, the speaker body may also be configured to make the voice coil vibrate in contact with the carbonaceous acoustic vibration plate. Alternatively, a configuration may also be adopted in which the carbonaceous acoustic vibration plate is supported by a flexible film and the voice coil is made vibrate in contact with the film.

Advantageous Effects of Invention

The present invention can provide a speaker unit capable of directly driving a vibration plate having a low density, light weight yet sufficient rigidity with a digital audio signal, transmitting vibration of the voice coil to the carbonaceous acoustic vibration plate without loss and realizing excellent acoustic characteristics.

DESCRIPTION OF EMBODIMENTS

Hereinafter, embodiments of the present invention will be described in detail with reference to the accompanying drawings. An embodiment of the present invention is a digital speaker unit including a carbonaceous acoustic vibration plate as a vibration plate of a speaker body, for directly driving a voice coil with a digital signal supplied from a digital sound source to cause the carbonaceous acoustic vibration plate to vibrate. The present invention is suitable for use in a digital speaker unit, but is also applicable to a drive scheme using an analog audio signal.

First Embodiment

Figure 1:
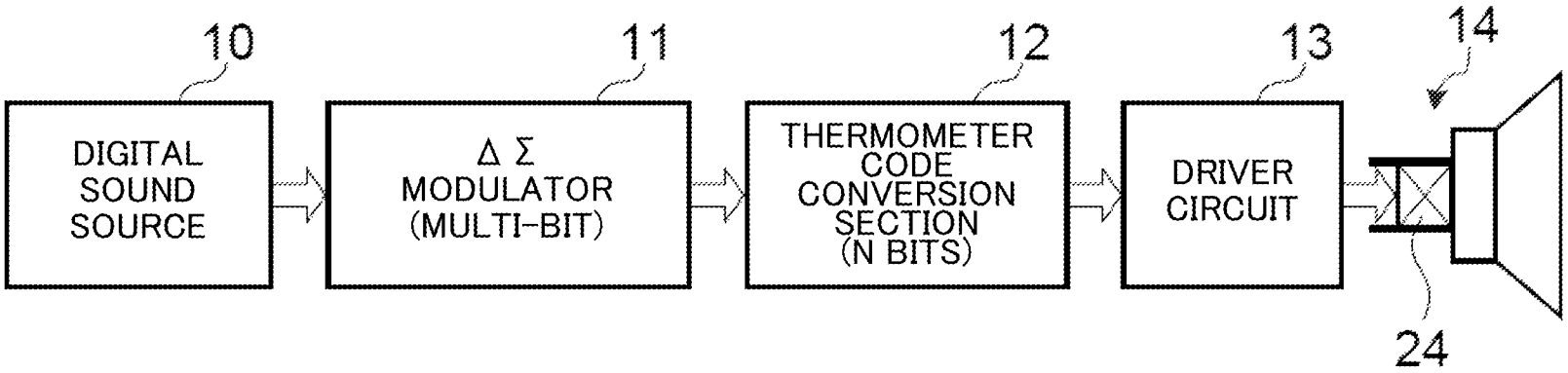
FIG. 1 is an overall schematic view of a digital speaker unit according to a first embodiment of the present invention.

FIG. 1 is an overall schematic view of a digital speaker unit according to a first embodiment of the present invention. In FIG. 1, a digital sound source 10 may be comprised of a CD player, DVD player or other digital devices for sound reproducing and outputs a digital audio signal to a digital speaker unit.

The digital speaker unit according to the present embodiment includes a multi-bit delta-sigma modulator 11, a thermometer code conversion section 12 that converts a digital signal outputted from the delta-sigma modulator 11 to a weightless N-bit thermometer code, a driver circuit 13 that performs drive control based on the thermometer code and a speaker body 14 comprising a carbonaceous acoustic vibration plate as principal components.

Figure 2:
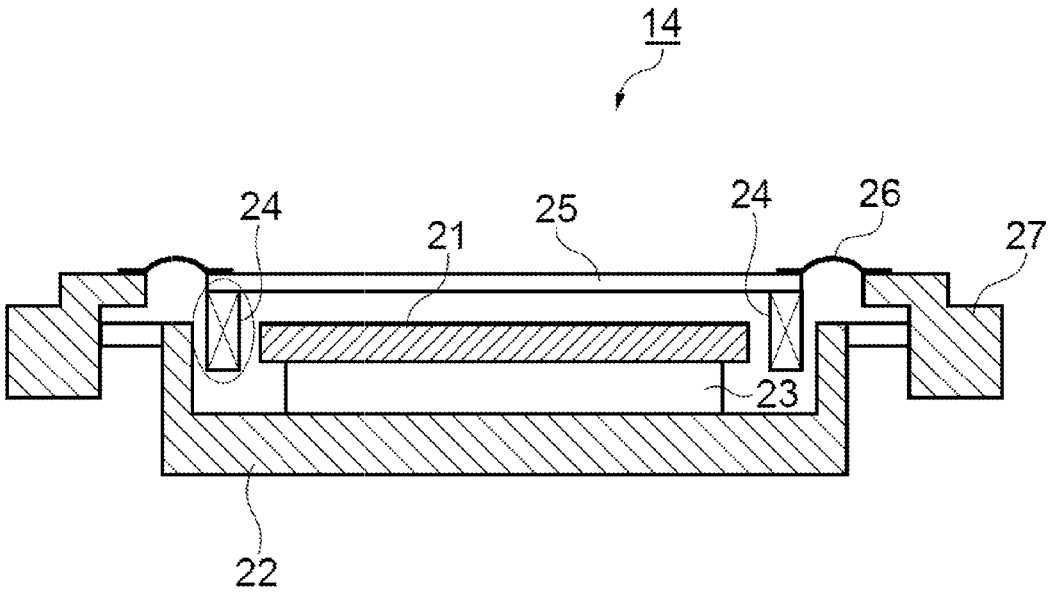
FIG. 2 is a schematic cross-sectional view showing a structure of the speaker body according to the first embodiment of the present invention.

The structure of the speaker body 14 will be described with reference to FIG. 2.

The speaker body 14 comprises a bottomed cylindrical yoke 22 having a center pole 21 in the center and a magnet 23 disposed at a proximal end of the center pole 21. The magnet 23, yoke 22 and center pole 21 constitute a magnetic circuit. Furthermore, in the magnetic circuit, the speaker body 14 comprises a plurality of voice coils 24 provided via a coil bobbin (not shown) that surround the outer circumference of the center pole 21 with a certain space in therebetween, and a carbonaceous acoustic vibration plate 25 attached at an end portion of the voice coil 24. The outer circumferential edge of the carbonaceous acoustic vibration plate 25 is supported by a frame 27 via an edge 26 in a vibratable manner. The number N of coils of the plurality of voice coils 24 corresponds to the number N of output bits of the thermometer code conversion section 12.

Figure 3:
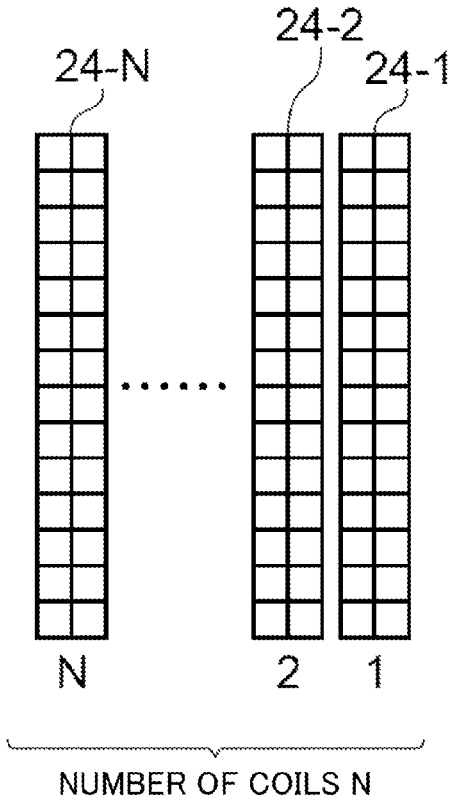
FIG. 3 is a schematic view showing an arrangement of a plurality of voice coils according to the first embodiment of the present invention.
Figure 4:
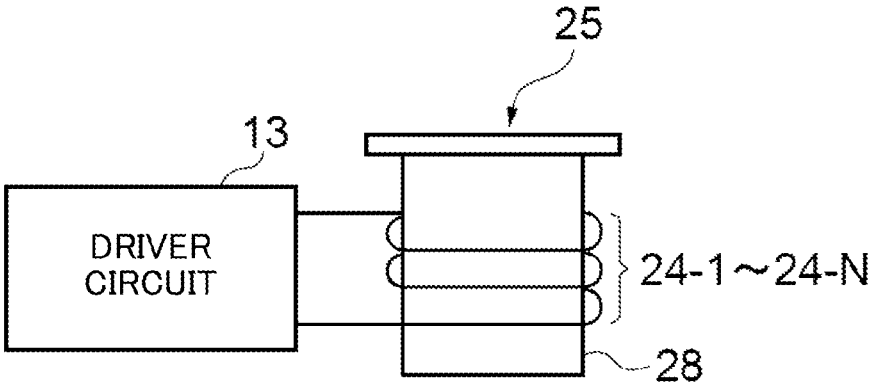
FIG. 4 is a schematic diagram showing a relationship between the voice coil, carbonaceous acoustic vibration plate and driver circuit according to the first embodiment of the present invention.
Figure 5:
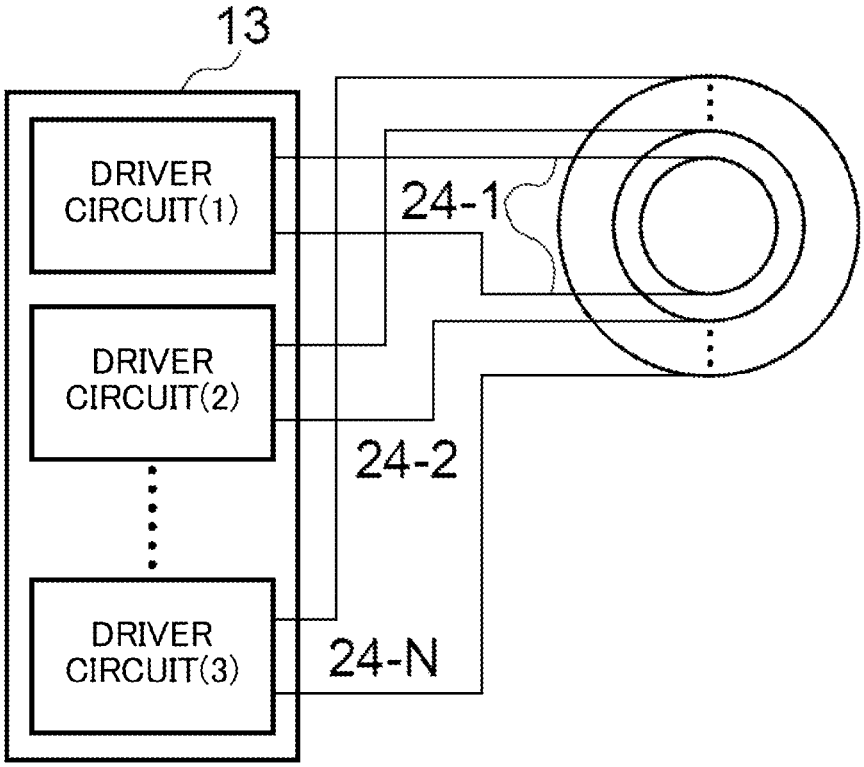
FIG. 5 is a circuit diagram showing a relationship between the voice coil and driver circuit according to the first embodiment of the present invention.

FIG. 3 to FIG. 5 show conceptual diagrams of the speaker drive system. N unit voice coils (24-1 to 24-N) are independently arranged (FIG. 3) and wound around a coil holding section 28, one end of which is connected to the carbonaceous acoustic vibration plate 25 (FIG. 4). Instead of using the coil holding section 28, a structure may also be adopted in which one ends of the unit voice coils (24-1 to 24-N) are directly connected to one surface of the carbonaceous acoustic vibration plate 25. Furthermore, as shown in FIG. 5, lead wires of the N (3 in FIG. 5) unit voice coils (24-1 to 24-N) are connected to their respective driver circuits 13(1) to (N) and drive currents independently flow from the corresponding driver circuits 13(1) to (N). The unit voice coils (24-1 to 24-N) are configured so as to be controllable independently of the driver circuits (1) to (N).

In the speaker body 14, a current flows through the voice coil 24 placed in the magnetic circuit made up of the magnet 23, yoke 22 and center pole 21 and a force generated in a direction orthogonal to a line of magnetic force in the voice coil 24 is used to cause the carbonaceous acoustic vibration plate 25 to vibrate to thereby generate a sound wave. A current corresponding to each bit value of the digital signal outputted from the thermometer code conversion section 12 flows into the voice coil 24.

Figure 6:
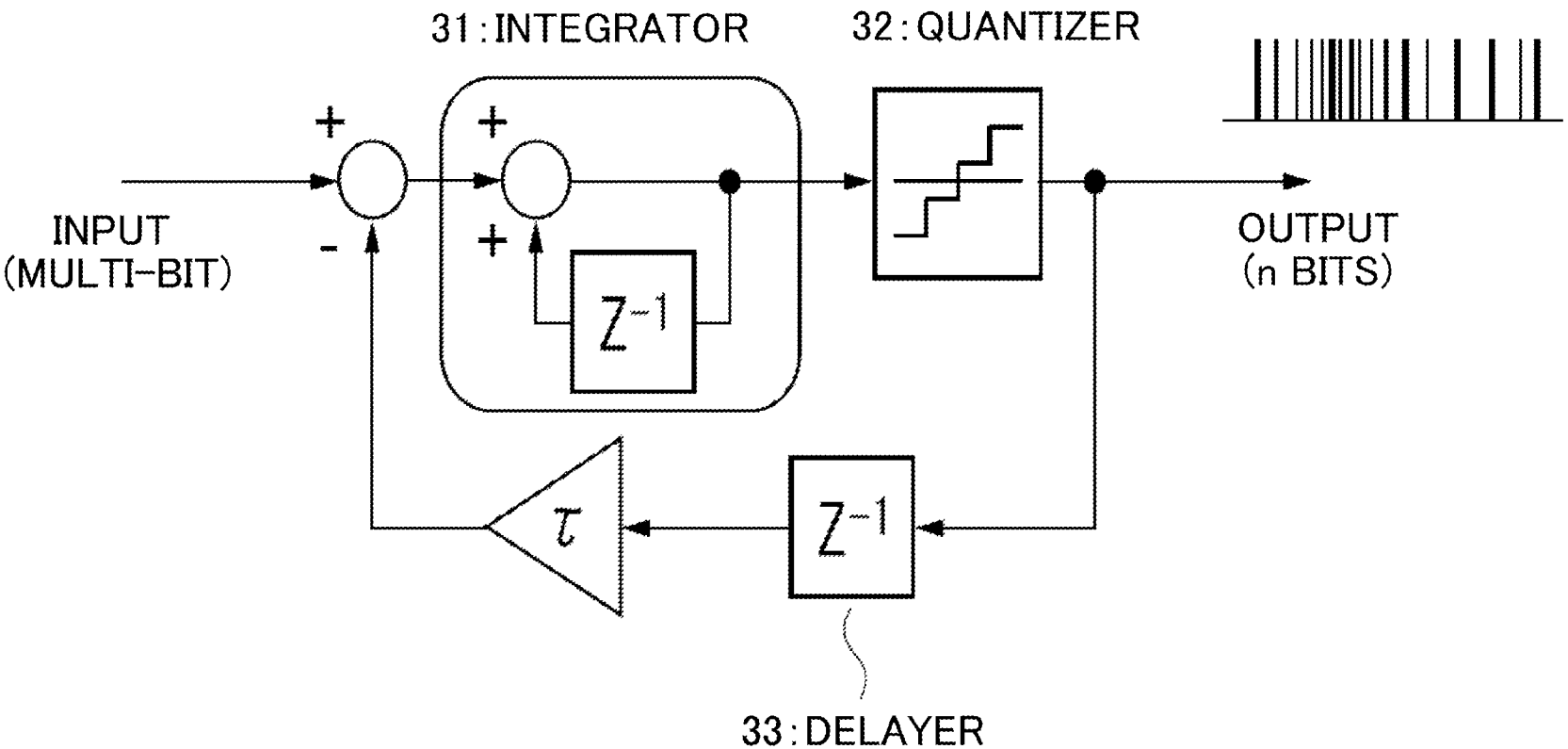
FIG. 6 is a circuit configuration diagram of the delta-sigma modulator according to the first embodiment of the present invention.

FIG. 6 is a circuit configuration diagram of the delta-sigma modulator 11. The circuit configuration shown in the figure is an example and a higher-dimension delta-sigma modulator may also be used. Here, suppose a digital audio signal expressed by multi-value input bits has 16 bits and the n-bit output from the delta-sigma modulator 11 is 4 bits.

The delta-sigma modulator 11 is basically configured by including an integrator 31, a quantizer 32, a delayer 33 and a feedback loop. $\tau$ represents a feedback gain. Multi-value bits (e.g., 16 bits) inputted to the delta-sigma modulator 11 pass through the integrator 31 and are converted to n bits (e.g., 9 values=4 bits) by the quantizer 32. A quantization error generated in quantization is returned to an input end via a feedback loop that passes through the delayer 33, a difference is taken and only the quantization error is integrated. Assuming X represents the input, Y represents the output and Q represents the quantization error, the relational expression is expressed by $Y=X+(1-Z^{-1})Q$. The transfer function $(1-Z^{-1})$ by which the quantization error Q is multiplied has a frequency characteristic and decreases in the vicinity of DC, and therefore this characteristic produces a noise shaping effect which will be described later.

In the delta-sigma modulator 11, the quantizer 32 quantizes the digital audio signal with multi-value bits into a number corresponding to the number n of output bits. The quantization error produced by the quantizer 32 can be corrected by applying an oversampling technique. Oversampling is one of techniques of sampling at a sufficiently higher frequency than a signal band. Furthermore, in the case of delta-sigma modulation, the accuracy of the original signal can be improved through the noise shaping effect. That is, when quantization is performed using the quantizer, quantization noise is uniformly distributed over all frequencies, but through delta-sigma modulation, unnecessary noise components are shifted to a high oversampled frequency domain, which suppresses noise in the vicinity of the original signal and has the effect of improving the accuracy of the original signal.

The thermometer code conversion section 12 converts n-bit output of the delta-sigma modulator 11 to an N-bit thermometer code corresponding to the number of voice coils. When, for example, the output is converted to an 8-bit thermometer code, delta-sigma modulator outputs (0010), (0101) and (1000) are converted to thermometer codes (00000011), (00011111) and (11111111) respectively. Since the binary number outputted from the delta-sigma modulator 11 is a bitwise weighted signal, using the signal as is may make direct drive in digital difficult, but by converting the output to a thermometer code with no bitwise weight, it is possible to directly drive the speaker body 14 with a digital signal.

Figure 7:
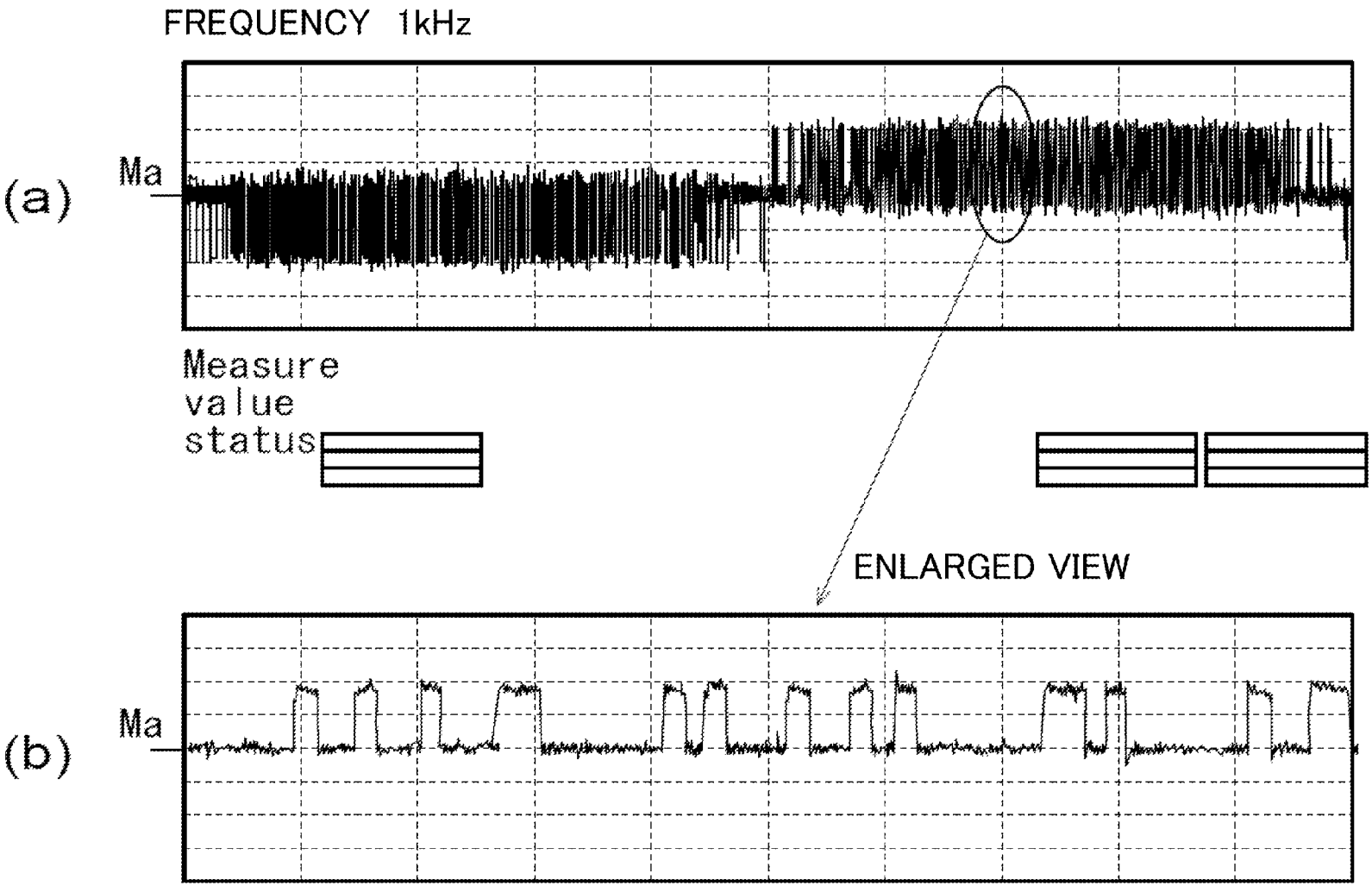
FIG. 7(*a*) is an overall waveform diagram of a digital signal to direct drive in digital the speaker according to the first embodiment of the present invention and FIG. 7(*b*) is a waveform diagram showing a partially enlarged view of the digital signal.

The driver circuit 13 drives the individual unit voice coils 24-1 to 24-N independently based on the thermometer code outputted from the thermometer code conversion section 12. To be more specific, each unit voice coil 24-1 to 24-N is associated with each bit value of the thermometer code in a one-to-one correspondence, a 1-bit signal (ON/OFF) as shown in FIGS. 7(*a*) and (*b*) is outputted from the thermometer code conversion section 12 for each bit of the thermometer code. Driving is performed so as to make a current flow to a voice coil 24 with thermometer code "1" and not to make any current flow to a voice coil 24 with thermometer code "0." The voice coil 24 itself moves in proportion to the current that flows through the voice coil 24 and the carbonaceous acoustic vibration plate 25 connected to the voice coil 24 vibrates to generate voice.

Next, the structure and manufacturing method of the carbonaceous acoustic vibration plate 25 used in the present embodiment will be described in detail.

The digital speaker unit of the present invention can use a carbonaceous vibration plate including a porous material containing amorphous carbon and carbon powder uniformly dispersed in the amorphous carbon and having a porosity of 40% or above as the carbonaceous acoustic vibration plate 25. The carbonaceous acoustic vibration plate 25 includes the porous material plate as a low-density layer and preferably further includes a high-density layer which contains amorphous carbon, is thinner than the low-density layer and has a higher density than the low-density layer.

Here, with regard to the number of layers, there can be various configurations such as a two-layer structure with a high-density layer and a low-density layer, a three-layer structure with one low-density layer sandwiched by two high-density layers or conversely a three-layer structure with one high-density layer sandwiched by two low-density layers or one-layer structure with only a high-density layer.

The shape of pores of the porous material is preferably spherical and the number average diameter of pores is preferably 5 μm or above and 150 μm or below. The carbon powder preferably contains carbon nanofibers having a number average diameter of 0.2 μm or below and an average length of 20 μm or below. The high-density layer may contain graphite uniformly dispersed in the amorphous carbon. When the carbonaceous acoustic vibration plate is dried and then left in an environment with a temperature of 25° C. and humidity of 60% for 250 hours, its mass increase is preferably 5% or below.

Furthermore, it is possible to manufacture the carbonaceous acoustic vibration plate using a method of uniformly mixing carbon-containing resin with carbon powder, molding the compound into a film shape, heating the compound to form a carbon precursor and carbonizing the carbon precursor in an inert atmosphere. In such a method of manufacturing a carbonaceous acoustic vibration plate, grains of a pore opening member which is solid or liquid at the carbon precursor formation temperature and disappears at the carbonizing temperature and leaves pores, are mixed with the compound beforehand, and in this way, a porous material is produced which contains amorphous carbon and carbon powder after the carbonization.

Before the carbonization, it is preferable to further include a step of creating a carbonaceous acoustic vibration plate including a low-density layer made of the porous material and a high-density layer having a higher density than the low-density layer after the carbonization by forming a layer of carbon-containing resin on at least one surface of the carbon precursor plate. The structure with the high-density layer sandwiched by the low-density layers is obtained, for example, by bonding, with resin, layers of carbon precursors containing a pore opening member to both sides of a carbon precursor containing no pore opening member, uniting the carbon precursors and carbonizing the united body.

The shape of grains of the pore opening member is preferably spherical. The carbon powder preferably contains carbon nanofibers. The layer of the carbon-containing resin may contain graphite uniformly dispersed therein. The carbonization is preferably performed under a temperature of 1200° C. or above.

As described above, by mixing the compound of carbon-containing resin and carbon powder with grains of a pore opening member such as polymethyl methacrylate (PMMA) which is solid or liquid at the carbon precursor formation temperature and disappears at the carbonizing temperature and leaves pores, this pore opening member disappears leaving cubic pores corresponding to the cubic shape thereof in the process of carbonization. Therefore, it is possible to easily control the porosity by controlling the composition ratio of the pore opening member, easily control the cubic shape and size of pores by selecting the cubic shape and size of grains of the pore opening member and realize a porous material having a porosity of 40% or above.

Here, the porosity is a volume percentage of pores with respect to the volume of the whole porous material containing the pores and is defined as a porosity calculated from the volume and mass of the whole porous material assuming a carbon density is 1.5 $g/cm^3$.

Adopting a multilayered structure with a low-density layer and a high-density layer made of the porous material makes it possible to set a porosity of 60% or above while maintaining necessary rigidity and set a density of the whole vibration plate to 0.5 $g/cm^3$ or below.

The high-density layer demonstrates its effect when the thickness thereof is on the order of 1 to 30% of the total thickness and plays the role of reproducing a high frequency range with a rigidity of Young's modulus of on the order of 100 GPa.

The low-density layer has Young's modulus of on the order of 2 to 3 GPa, reduces the weight of the whole vibration plate, maintains sound quality of the whole plate and improves vibration response.

These materials are united, sintered and carbonized to form a carbonaceous member having a plurality of layers, and it is thereby possible to realize a multilayered planar speaker vibration plate capable of controlling the characteristics and outputting sound in an audible sound range up to a high frequency range in particular.

Furthermore, it is also possible to provide rigidity by adopting a dome shape and obtain a planar vibration plate with a high reproduction limit frequency by balancing between a compact and high rigidity high-density layer and beam strength of a light weight, low-density layer which becomes the core. Although the sound reproduction range varies depending on the porosity design, the pore diameter has no considerable influence. The handling ability is excellent and shock resistance also improves. Furthermore, by covering one or both sides of the low-density layer of the porous material with the high-density layer, it is possible to prevent absorption of an adhesive when incorporated into the unit.

A characteristic further required for the acoustic vibration plate is to have a low hygroscopic property so that the acoustic characteristic does not change by absorbing water content in the air and becoming heavier. With the carbonization temperature set to 1200° C. or above, it is possible to obtain an acoustic vibration plate with amass increase of 5% or below when left in an environment with a temperature of 25° C. and a humidity of 60% for 250 hours after drying.

Although a structure in which the carbonaceous acoustic vibration plate is supported by a frame via edges has been described above as an example, it is also possible to adopt a structure in which the carbonaceous acoustic vibration plate is supported by a flexible film.

Figure 8:
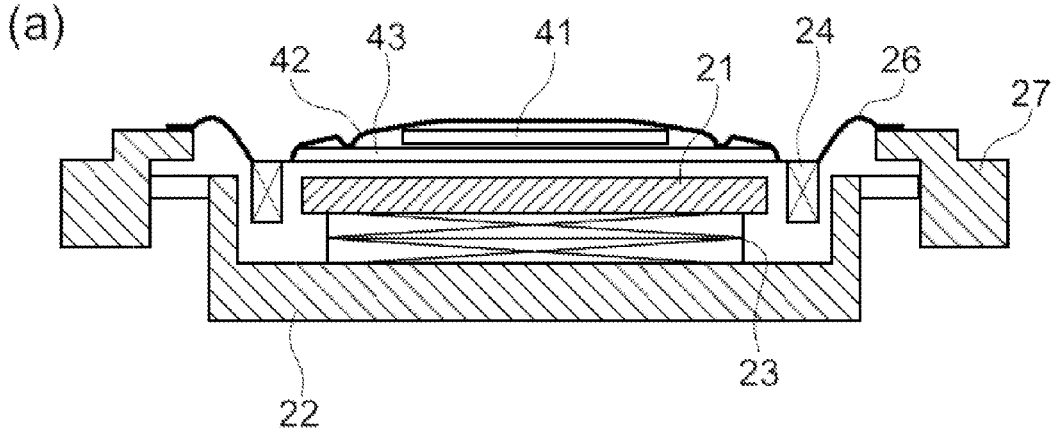
FIG. 8(*a*) is a cross-sectional view of a speaker body in which the carbonaceous acoustic vibration plate is supported by the flexible film according to the first embodiment of the present invention and FIG. 8(*b*) is a plan view of FIG. 8(*a*)
Figure 8:
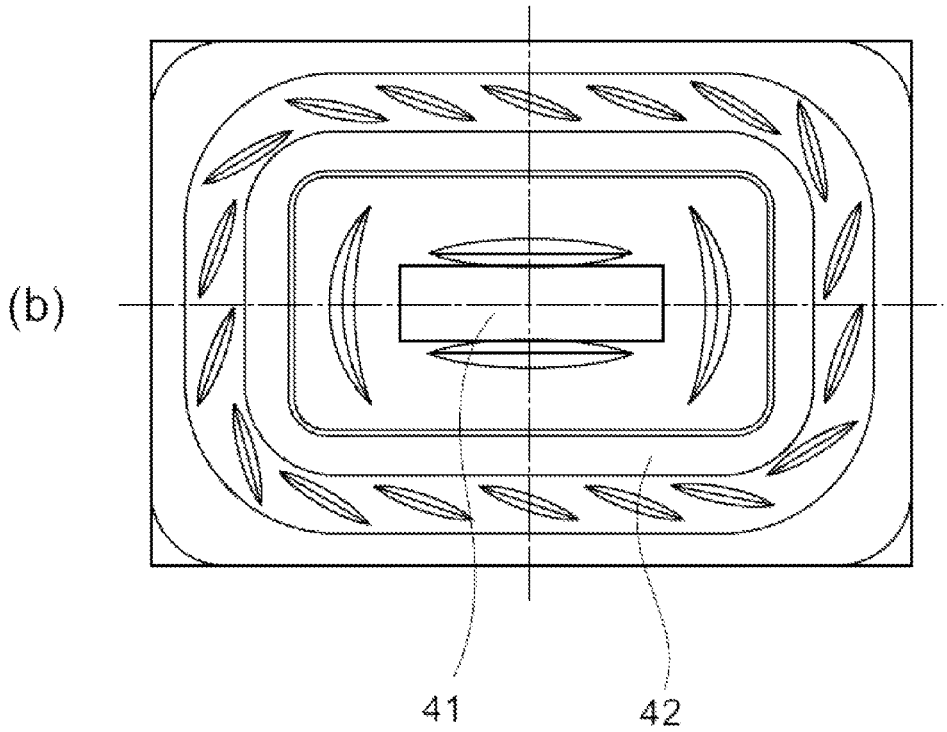

FIG. 8(*a*) is a cross-sectional view of a speaker body in which the carbonaceous acoustic vibration plate is supported by a flexible film and FIG. 8(*b*) is a plan view thereof. As shown in FIG. 8(*a*), a yoke 22, magnet 23, center pole 21, voice coil 24 and frame 27 have a structure similar to that of the speaker body 14 shown in FIG. 2. A carbonaceous acoustic vibration plate 41 is fixed to the inner surface of a flexible film 42. The flexible film 42 has a shape with a dome-like swollen central portion and is fixed to the top surface of a tabular film base 43. A structure is configured such that one end of a voice coil 24 contacts the undersurface of the outer circumferential edge of the film base 43 to transmit vibration. The flexible film 42 is subjected to concavo-convex processing for securing the strength.

A digital drive system as shown in FIG. 1 is connected to the speaker body configured above to constitute a digital speaker unit. The method of driving the speaker body using a digital audio signal supplied from a digital sound source is as described above.

By supporting the carbonaceous acoustic vibration plate 41 by the flexible film 42 with required rigidity and flexibility, it is possible to realize a high sound pressure compared to the structure in which the carbonaceous acoustic vibration plate is supported by a frame. A verification experiment conducted by the present inventor shows that a peak sound pressure of 90 dBspl could be realized by combining a film and the carbonaceous vibration plate. Therefore, for application requiring a high sound pressure, a configuration as shown in FIG. 8 is preferable in which the carbonaceous acoustic vibration plate 41 is supported by the flexible film 42.

Second Embodiment

Figure 9:
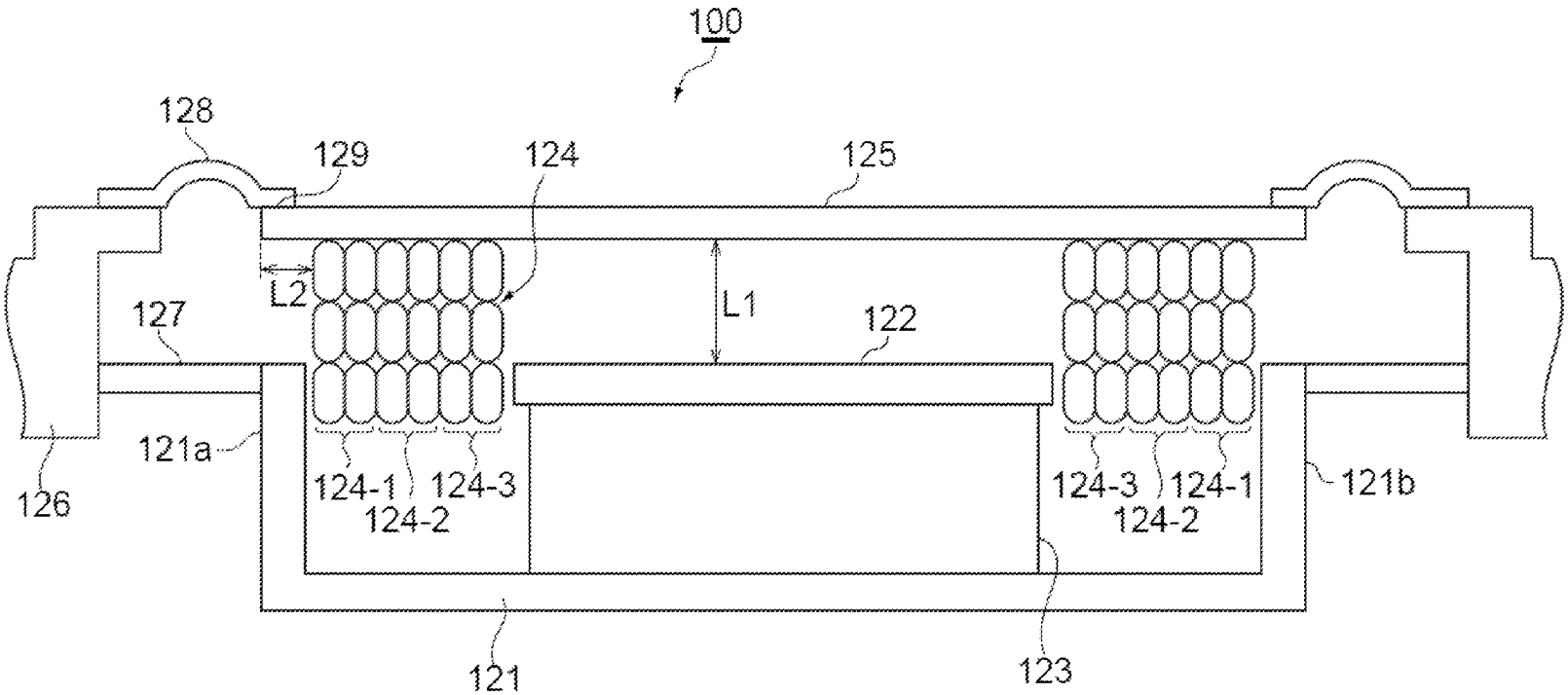
FIG. 9 is a diagram illustrating a cross-sectional structure of a speaker body of a digital speaker unit according to a second embodiment of the present invention.

Next, a second embodiment of the present invention will be described. FIG. 9 is a schematic view illustrating a configuration of a digital speaker unit according to a second embodiment of the present invention and shows a cross-sectional structure of the speaker body. The same components as those in the first embodiment will be assigned the same reference numerals and descriptions thereof will be omitted and only differences from the first embodiment will be mainly described.

A speaker body 100 comprises a yoke 121 made up of an iron piece and having a U-shaped cross section, a centerpiece 122, a magnet 123, a cylindrical voice coil 124 and a carbonaceous acoustic vibration plate 125. The yoke 121 forms a bottomed cylindrical body having a slightly greater inner diameter than the outer diameter of the voice coil 124. A yoke wall portion 121*a* (121*b*) that stands upright from the bottom outer circumferential edge of the yoke 121 faces the outer circumferential surface of the voice coil 124. The centerpiece 122 is placed in the inner space of the voice coil 124.

The magnet 123 is placed between the undersurface of the centerpiece 122 and the opposed surface (top surface of the yoke) on the yoke 121. The top surface of the magnet 123 contacting the undersurface of the centerpiece 122 is polarized to one magnetic pole (e.g., N pole) and the undersurface contacting the top surface of the yoke 121 is polarized to the other magnetic pole (e.g., S pole). The magnet 123, yoke 121 and centerpiece 122 together constitute a magnetic circuit.

The shapes of the yoke 121 and centerpiece 122 in a plan view are not particularly limited, but when the yoke 121 has a bottomed cylinder shape or rectangular box shape, the centerpiece 122 may have the same shape (similar shape), that is, a circular or rectangular shape and may be set to have such a size that allows a gap to be formed between the yoke wall portions 121*a* and 121*b*, and the outer circumferential portion of the centerpiece 122.

The voice coil 124 is placed in the gap formed between the yoke wall portion 121*a* (121*b*) and the outer circumferential edge of the centerpiece 122. The voice coil 124 is configured by stacking a plurality of unit voice coils 124-1, 124-2 and 124-3 one on another in the diameter direction. The number N of the plurality of unit voice coils 124-1, 124-2 and 124-3 corresponds to the number N of output bits of the thermometer code conversion section 13. The voice coils 124 are arranged such that at least some of the voice coils 124 extend across the gap formed with the yoke wall portion 121*a* (121*b*) and the outer circumferential edge of the centerpiece 122. FIG. 9 shows an example where the lower part of the voice coil 124 extends across the gap. The unit voice coils 124-1, 124-2 and 124-3 are configured by cylindrically winding a conductive wire crushed so as to have an oblong cross section.

The carbonaceous acoustic vibration plate 125 is arranged at a predetermined distance L1 from the top surfaces of the yoke 121 and centerpiece 122. The carbonaceous acoustic vibration plate 125 has an outer diameter greater than that of the voice coil 124. One open end portion of the voice coil 124 is bonded and fixed to the undersurface of the carbonaceous acoustic vibration plate 125 in direct contact therewith. That is, one end portion of the voice coil 124 is fixed to the carbonaceous acoustic vibration plate 125 side and the other open end portion of the voice coil 124 is left open. Furthermore, the voice coil 124 is mounted such that the outermost circumferential position thereof in the diameter direction is located inward at a predetermined distance L2 from the outer circumferential edge of the carbonaceous acoustic vibration plate 125.

A frame 126 is placed so as to surround the outer circumferences of the yoke 121, voice coil 124 and carbonaceous acoustic vibration plate 125. The frame 126 supports the yoke 121 via a supporting member 127 of high rigidity and supports the carbonaceous acoustic vibration plate 125 via an elastic edge 128 in a vibratable manner. The edge 128 preferably has a function of supporting the carbonaceous acoustic vibration plate 125 in a vibratable manner and a damper function of preventing vibration of the carbonaceous acoustic vibration plate 125 from continuing.

As described above, the outermost circumferential position of the voice coil 124 in the diameter direction is located inward at the predetermined distance L2 from the outer circumferential edge of the carbonaceous acoustic vibration plate 125. The present embodiment secures a mounting portion 129 for fixing a vibration plate side end of the edge 128 within the range from the outer circumferential edge of the carbonaceous acoustic vibration plate 125 to the distance L2, which is a region in which the one open end portion of the voice coil 124 is not in direct contact. That is, the vibration plate side end of the edge 128 is fixed to the mounting portion 129 and the frame side end thereof is fixed to part of the frame 126.

Figure 10:
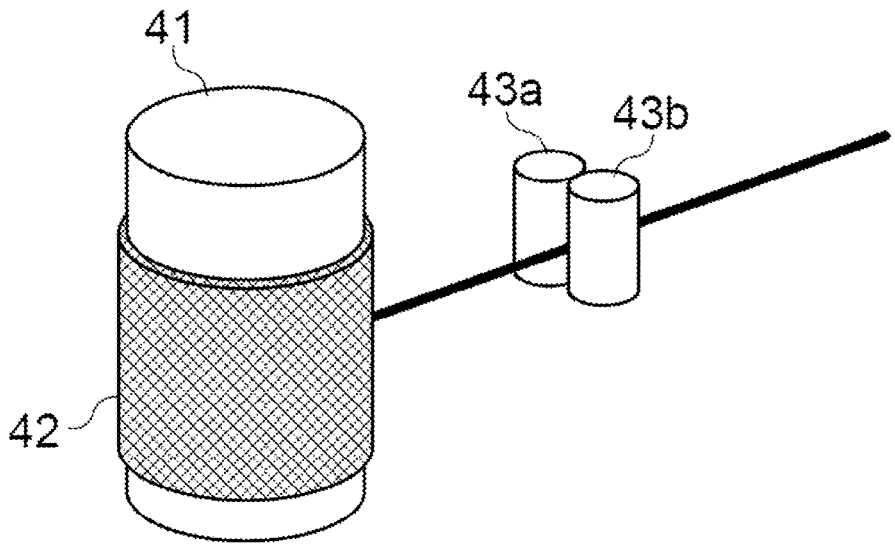
FIG. 10 is a diagram illustrating how a coil wire is unreeled from a drum and passed between rollers according to the second embodiment of the present invention.
Figure 11:
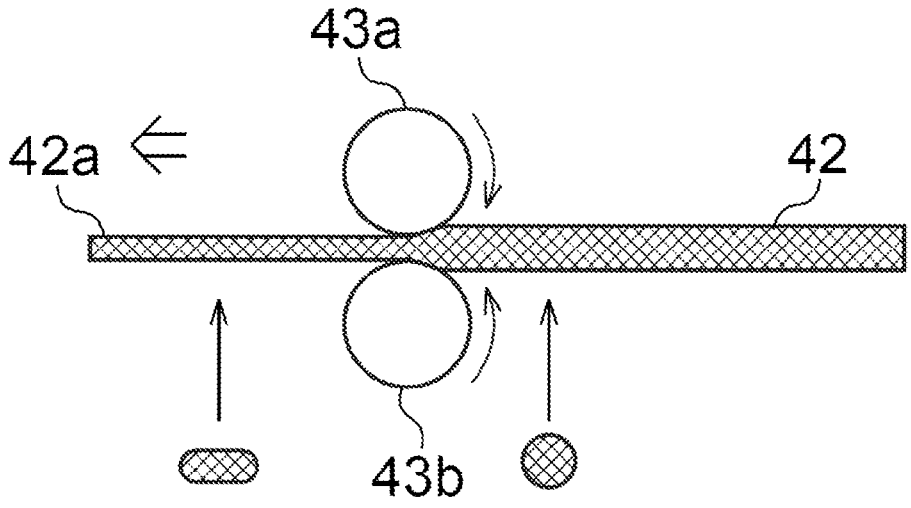
FIG. 11 is a diagram illustrating a cross-sectional shape of the coil wire before and after passing between the rollers according to the second embodiment of the present invention.

Here, manufacturing steps of the voice coil 124 will be described with reference to FIG. 10 to FIG. 13. As shown in FIG. 10, a coil wire 42 wound around a drum 41 is unreeled and crushed as it passes between a pair of rollers 43*a* and 43*b*. As a result, as shown in FIG. 11, the coil wire 42*a* after passing between the rollers is deformed from a perfect circular to oblong cross-sectional shape.

Figure 12:
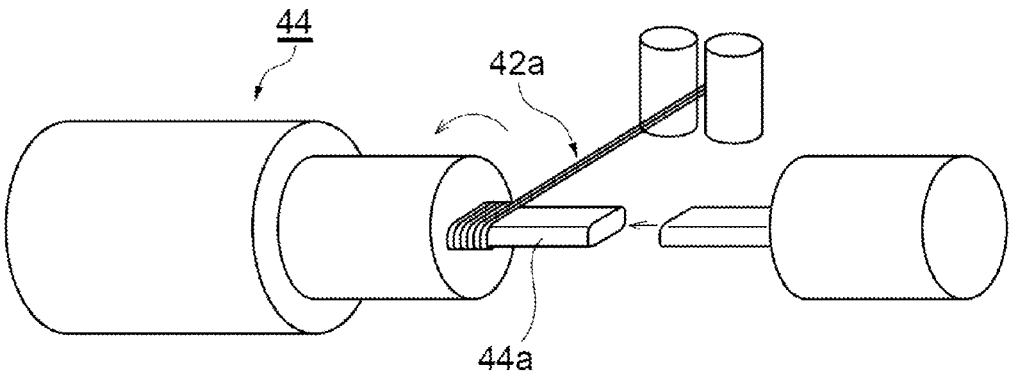
FIG. 12 is a diagram illustrating how the crushed coil wire is reeled around a winding jig according to the second embodiment of the present invention.

Next, as shown in FIG. 12, the coil wire 42*a* whose cross-sectional shape is deformed into an oblong shape is wound around a winding jig 44 so as to have the cylindrical shape of the voice coil 124. In the case of the three-channel (124-1, 124-2, 124-3) structure shown in FIG. 9, the unit voice coil 124-3 located innermost is wound around the winding jig 44 first. The winding section 44*a* of the winding jig 44 preferably has the same shape as the cross-sectional shape of the voice coil 124 in the diameter direction. Although FIG. 12 schematically illustrates an oblong shape, an arbitrary shape may be adopted using winding sections 44*a* having circular, ellipsoidal, rectangular cross sections or the like. The winding width can be adjusted by replacing a plug-in type winding section 44*a*.

Figure 13:
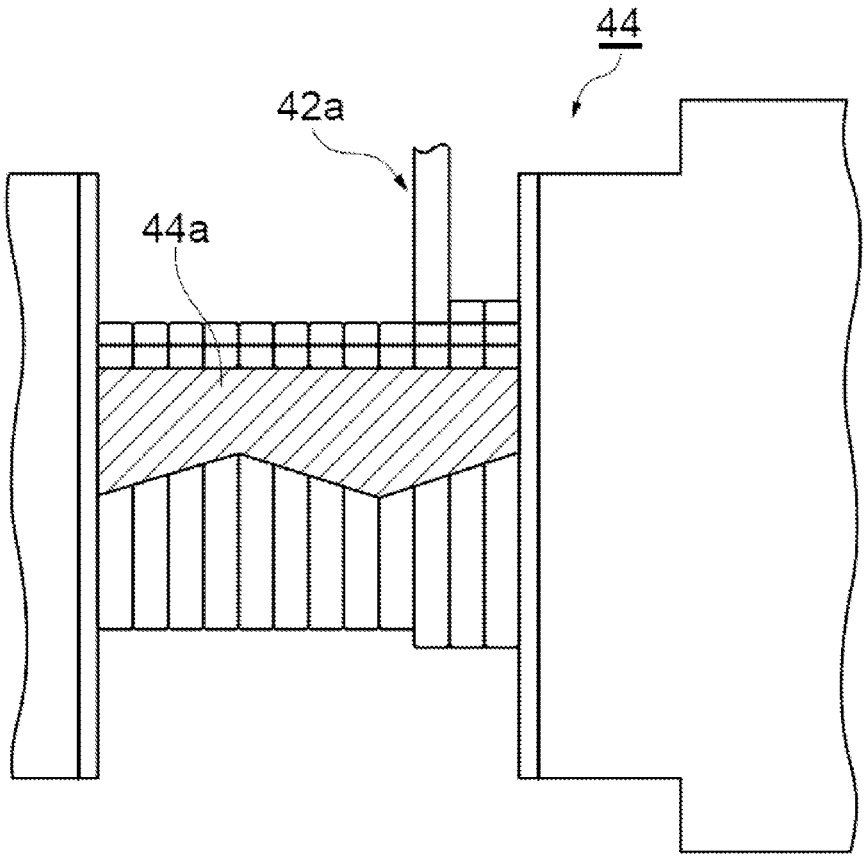
FIG. 13 is a partial cross-sectional view of the winding jig around which the crushed coil wire has been reeled according to the second embodiment of the present invention.

FIG. 13 is a cross-sectional view when winding using the winding jig 44 is in progress. The wire is wound by placing the surface crushed into an oblong shape of the coil wire 42*a* set as the winding surface side of the winding section 44*a* and wound densely so that there remain no spaces between the neighboring coil wires 42*a* in the direction of the axis of rotation. This makes it possible to obtain a unit voice coil in which the wire is cylindrically wound such that the wires neighboring in the direction orthogonal to the coil diameter direction are arranged in close contact with each other in the major axis direction of the cross-section of the wire.

When two layers of wire are wounded around the outer circumferential surface of the winding section 44*a* of the winding jig 44, the winding operation of the innermost unit voice coil 124-3 is completed. Both end portions of the coil wire 42*a* making up the unit voice coil 124-3 are led out and made connectable to a driver circuit which will be described later. The lead positions of the coil wire 42*a* will be described in detail later.

Next, the coil wire 42*a* making up the unit voice coil 124-2 located in the middle is wound around the outer circumferential surface of the innermost unit voice coil 124-3 in the same way as for the unit voice coil 124-3. In this case, since the coil wire 42*a* is crushed so as to have an oblong cross-section and the wires are stacked one on another such that the crushed surfaces contact each other, it is possible to stack the wires one on another without unbalanced wire alignment. When the winding operation of the middle unit voice coil 124-2 is completed, winding of the outermost unit voice coil 124-1 is performed likewise.

As described above, winding the coil wire 42*a* for an outer unit voice coil around the outer circumference of an inner unit voice coil results in a structure in which a unit voice coil on a smaller diameter side is sequentially inserted in a unit voice coil on a greater diameter side.

To transmit vibration created in the produced voice coil 124 to the carbonaceous acoustic vibration plate 125 efficiently (without loss), it is preferable to densely arrange the coil wire in the direction orthogonal to the diameter direction and also preferable that the unit voice coils be united. Thus, to unite the unit voice coils, it is preferable to harden the entire coil using, for example, hardening resin after winding the coil wire.

Thus, the voice coil 124 is obtained resulting from uniting the unit voice coils 124-1, 124-2 and 124-3 corresponding to a plurality of channels. One open end portion of this voice coil 124 is placed in contact with the undersurface of the carbonaceous acoustic vibration plate 125 and bonded thereto.

When the unit voice coil is made to vibrate as a single unit, the winding jigs 44 having the winding sections 44*a* corresponding to the inner diameters of the respective unit voice coils are prepared respectively and unit voice coils of different inner diameters are manufactured one by one. Each unit voice coil is hardened using hardening resin. After that, a unit voice coil of a next smaller diameter is inserted inside a unit voice coil of a greater diameter and a plurality of unit voice coils of different inner diameters are thereby combined into one voice coil 124.

In the case of a small speaker unit mounted on a mobile phone or the like, the tension of the lead wires led out from the unit voice coils 124-1, 124-2 and 124-3 has a great influence on the vibration characteristics of the carbonaceous acoustic vibration plate 125. As the size and weight of the carbonaceous acoustic vibration plate 125 decrease, the influence of the lead wires on the vibration characteristics increases. On the other hand, every time the number of channels (number of unit voice coils N) increments by 1, two lead wires are added, and therefore the number of lead wires increases as the number of channels increases. For this reason, for the lead wires led out from the unit voice coils 124-1, 124-2 and 124-3, such a lead structure is required that does not cause the vibration characteristics of the carbonaceous acoustic vibration plate 125 to deteriorate.

Figure 14:
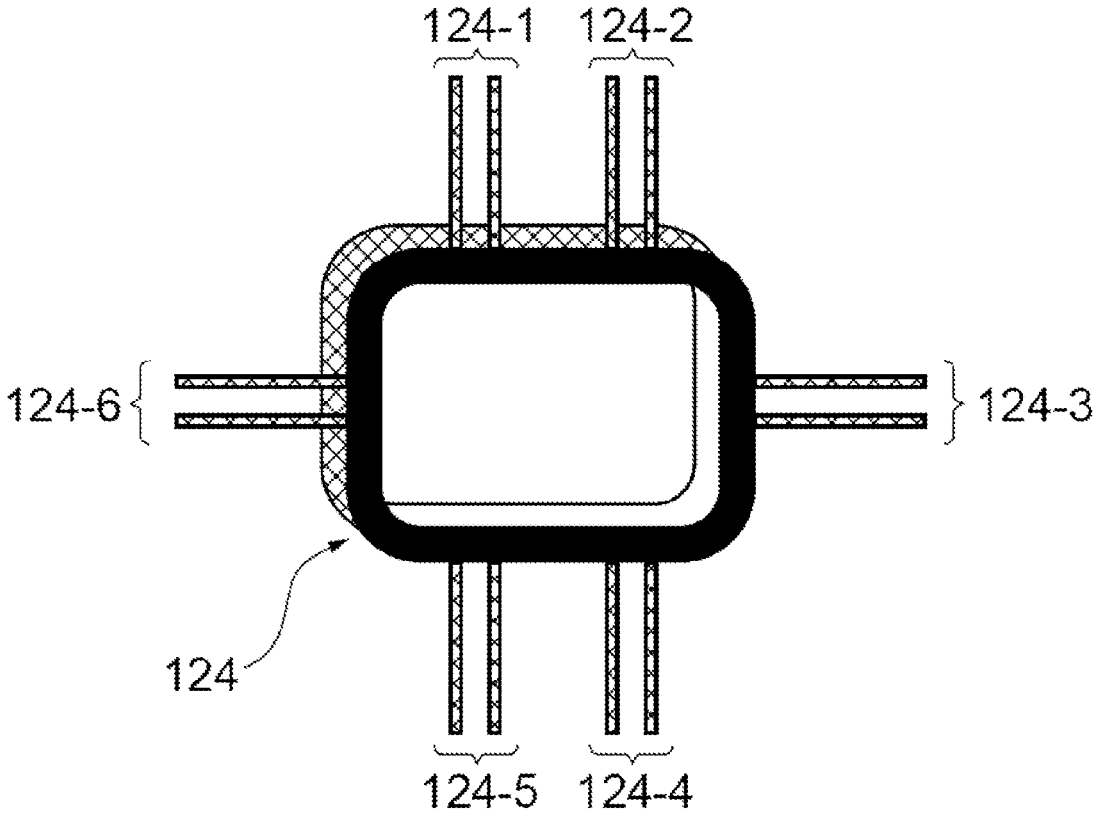
FIG. 14 is a diagram illustrating lead positions of the lead wires of the voice coil according to the second embodiment of the present invention.

FIG. 14 is a schematic perspective view showing a lead arrangement in the voice coil 124 comprising six unit voice coils. Two lead wires are led out from each of six unit voice coils 124-1 to 124-6. As shown in the same figure, in the case of the rectangular carbonaceous acoustic vibration plate 125, two lead wires from each of the unit voice coil sets (124-1, 124-2) and (124-4, 124-5), a total of four lead wires are led out from each long side and two lead wires are led out from each of the unit voice coils 124-3 and 124-6 from each short side. Thus, it is preferable to uniformly distribute lead positions of the lead wires from the carbonaceous acoustic vibration plate 125 over the total outer circumference of the vibration plate. Since the configuration of the drive system that drives the voice coil 124 is the same as that of the first embodiment, descriptions thereof will be omitted.

As shown in FIG. 9, the speaker body 100 of the present embodiment has the structure in which one end of the voice coil 124 directly contacts the carbonaceous acoustic vibration plate 125, and therefore vibration excited by the voice coil 124 is transmitted to the carbonaceous acoustic vibration plate 125 in response to a digital audio signal without loss. That is, since vibration excited by the digitally drivable voice coil 124 is transmitted to the carbonaceous acoustic vibration plate 125 with high efficiency, it is possible to realize a digital speaker capable of outputting a sound accurately reproducing a digital audio signal.

Furthermore, since one end portion of the voice coil 124 directly contacts the carbonaceous acoustic vibration plate 125, heat (Joule's heat) produced in the voice coil 124 is transmitted to the carbonaceous acoustic vibration plate 125 and can be dissipated efficiently. That is, the present embodiment allows the carbonaceous acoustic vibration plate 125 having excellent thermal conduction characteristics to act as a heat sink of the voice coil 124. As a result, it is possible to prevent deterioration of the characteristics due to heat generation in the voice coil 124 and also simplify the configuration by simplifying heat dissipation measures.

Since the carbonaceous acoustic vibration plate 125 is supported by the frame 126 via the edge 128 having a damper function, the carbonaceous acoustic vibration plate 125 vibrates in response to digital data, but the vibration corresponding to the digital data is immediately absorbed by the edge 128 so as not have any adverse influence on the vibration corresponding to the following voice data.

Moreover, the side end portion of the vibration plate of the edge 128 having the damper function is fixed to the mounting portion 129 deviated outward from the contacting position of the voice coil 124. For this reason, the edge 128 having the damper function directly absorbs vibration given by the voice coil 124 to the carbonaceous acoustic vibration plate 125, and can thereby solve the problem that the carbonaceous acoustic vibration plate 125 becomes inflexible and suppress deterioration of the vibration characteristics of the carbonaceous acoustic vibration plate 125 to a minimum.

Furthermore, since the voice coil 124 is made up of the coil wire 42 crushed into an oblong cross-sectional shape and wound multi fold with the planar side stacked one on another in multiple layers, it is possible to reduce the difference between the inner diameter and the outer diameter of the voice coil as a whole to a small size when the plurality of unit voice coils 124-1 to 124-3 are stacked one on another in multiple layers. When the gap formed between the yoke ends 121*a* and 121*b* and the outer circumferential edge of the centerpiece 122 is small, magnetic loss can be reduced, and the difference between the inner diameter and outer diameter of the voice coil 124 arranged in the gap can be reduced to a small size, and therefore it is possible to reduce the size of the gap and realize efficient drive with suppressed magnetic loss.

Next, a modification example of the speaker body 1 will be described.

Figure 15:
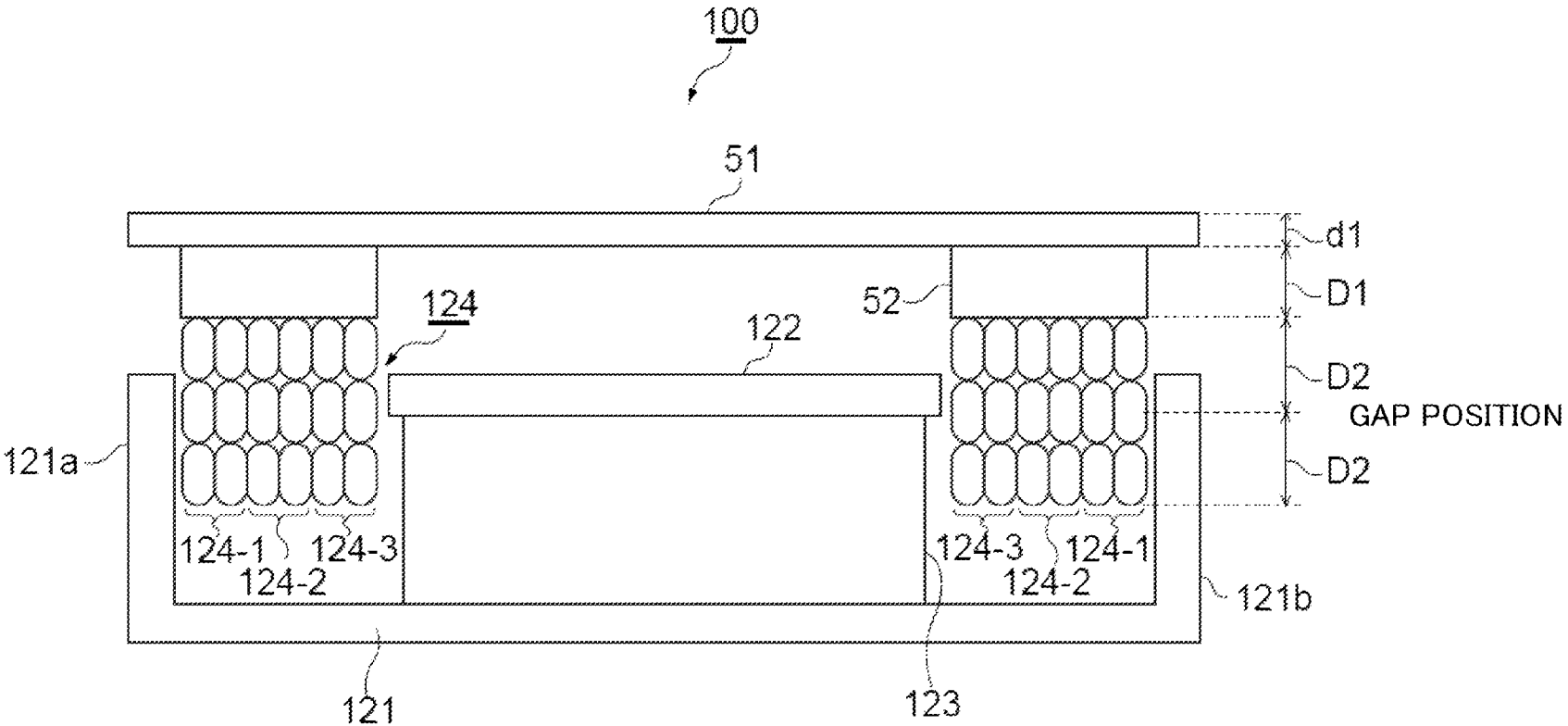
FIG. 15 is a configuration diagram of the speaker body with a convex portion formed on a carbonaceous acoustic vibration plate according to a modification example of the present invention.

FIG. 15 shows an example where a convex portion for adjusting the height position of the voice coil is formed in the carbonaceous acoustic vibration plate. The same configuration as the aforementioned embodiment may be applied to the circuit configuration of the drive system.

When at least part of the voice coil 124 is interposed in the gap formed between the yoke wall portions 121*a* and 121*b* and the outer circumferential edge of the centerpiece 122, a certain degree of magnetic flux can cross the voice coil 124. In particular, such an arrangement that the central portion of the voice coil 124 comes to a position in the gap causes the number of magnetic fluxes crossing the voice coil 124 to become a maximum and a current flow through the voice coil 124 produces maximum force. That is, as shown in FIG. 15, the arrangement that the central portion of the voice coil 124 comes to a position in the gap allows the carbonaceous acoustic vibration plate 51 to vibrate most efficiently.

Here, a sufficient space in consideration of a maximum vibration stroke is set between a carbonaceous acoustic vibration plate 51 (undersurface) and the centerpiece 122 (top surface) to secure the stroke during vibration of the carbonaceous acoustic vibration plate 51. Therefore, there is a limit to adjusting the positional relationship between the voice coil 124 and the gap position by adjusting the distance between the carbonaceous acoustic vibration plate 51 (undersurface) and the centerpiece 122 (top surface). On the other hand, if the voice coil 124 is extended in length on the side opposite to the vibration plate (downward in FIG. 16(*a*)), the central portion of the voice coil 124 can be placed at a position in the gap. However, when the voice coil 124 is extended in length, the wire distance increases, hence the weight increases. As described above, since the carbonaceous acoustic vibration plate 51 directly holds the voice coil 124, the measure in the direction in which the weight of the voice coil 124 increases is not desirable.

Thus, a structure is adopted in which a convex portion 52 from which the voice coil mounting portion protrudes is formed on the carbonaceous acoustic vibration plate 51 and one end portion of the voice coil 124 is bonded and fixed to the convex portion 52. The height D1 of the convex portion 52 is adjusted to a size in which the central portion of the voice coil 124 comes to a position in the gap. In FIG. 15, the position at a distance D2 from one end portion of the voice coil 124 corresponds to the central portion.

The formation of the convex portion 52 on the carbonaceous acoustic vibration plate 51 causes the weight to increase by the amount corresponding to the convex portion 52. Thus, the convex portion 52 may be hollowed out to suppress the increase in the weight. Alternatively, the thickness d1 of the carbonaceous acoustic vibration plate 51 other than the convex portion 52 may be reduced to suppress the increase in the total weight.

According to such a modification example, the convex portion 52 in which the voice coil mounting portion of the carbonaceous acoustic vibration plate 51 is made to protrude is formed and the central portion of the voice coil 124 is arranged so as to come to a position in the gap, and it is thereby possible to maximize the number of magnetic fluxes that pass through the voice coil 124 and allow the carbonaceous acoustic vibration plate 51 to vibrate most efficiently.

Figure 16:
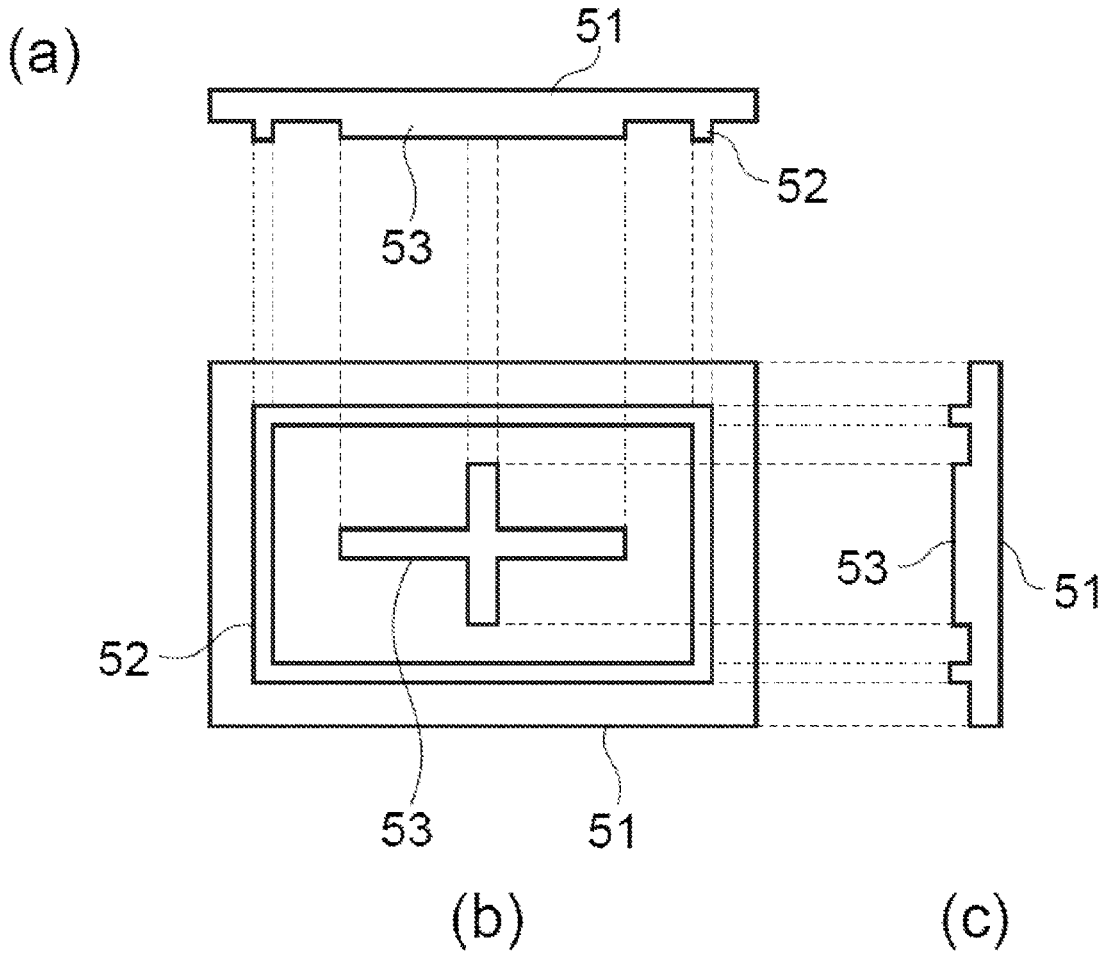
FIG. 16 is a configuration diagram of the speaker body with a convex portion and a rib portion formed on the carbonaceous acoustic vibration plate according to the modification example of the present invention.

As shown in FIG. 16, the convex portion 52 is formed on the carbonaceous acoustic vibration plate 51 and the thickness d1 of the carbonaceous acoustic vibration plate 51 is reduced. This causes the bending strength of the carbonaceous acoustic vibration plate 51 to reduce, and therefore a rib portion 53 for reinforcement may be formed on the surface of the vibration plate to increase the strength. Although the rectangular carbonaceous acoustic vibration plate 51 is illustrated in the same figure, the present invention is also applicable to other shapes.

Figure 17:
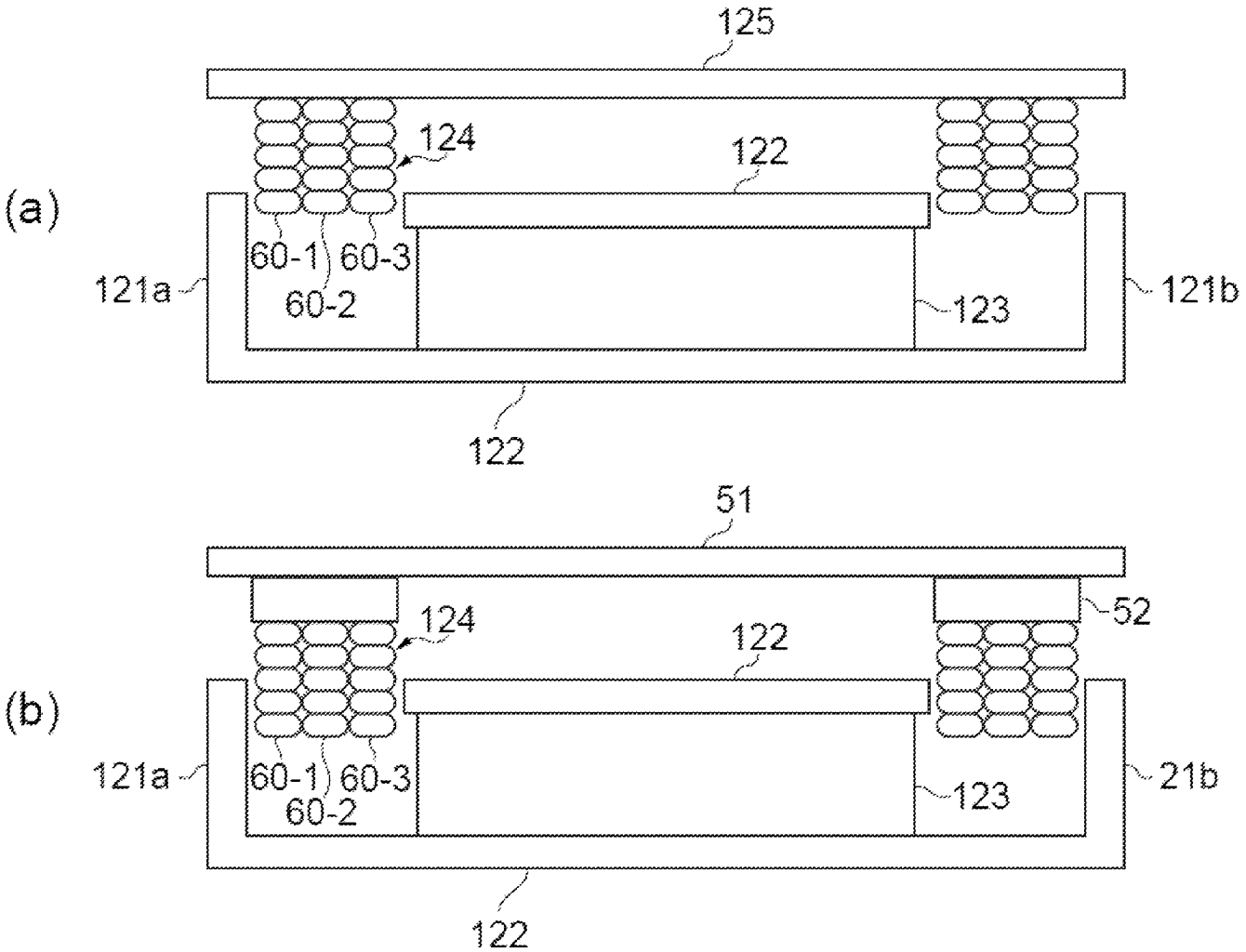
FIGS. 17(*a*) and (*b*) are diagrams illustrating a modification example of the voice coil in the modification example of the present invention.

FIGS. 17(*a*) and (*b*) are diagrams illustrating a modification example of the speaker body where the voice coil wire stacking direction is changed. FIG. 17(*a*) shows the same basic structure as that of the speaker body 100 shown in FIG.

9 and FIG. 17(*b*) shows the same basic structure as that of the speaker body 100 shown in FIG. 17.

The speaker body shown in FIGS. 17(*a*) and (*b*) is configured by stacking coil wires resulting from crushing each unit voice coil 60-1, 60-2, 60-3 making up the voice coil 124 into an oblong shape and stacking the crushed wires so that their planar surfaces are stacked on one another. Each unit voice coil is created by winding the coil wire around a winding section 44*a* of a winding jig 44 so that each crushed surface is stacked one on another. Thus, in each unit voice coil, the coil wires are arrayed in close contact with each other, which further suppresses loss when vibration excited by the voice coil 124 is transmitted to the carbonaceous acoustic vibration plate 51.

As shown in FIGS. 17(*a*) and (*b*), by reducing the number of stacks (one) of each unit voice coil in the diameter direction, it is possible to prevent the gap between the yoke end portions 121*a* and 121*b* and the outer circumferential portion of the centerpiece 122 from increasing.

Although a structure has been described above where the carbonaceous acoustic vibration plate is supported by a frame via an edge, it is also possible to adopt a structure in which the carbonaceous acoustic vibration plate is supported by a flexible film. The open end portion of the carbonaceous acoustic vibration plate is fixed to the film surface of the flexible film, the flexible film is fixed to the frame via the edge in a vibratable manner. Since the carbonaceous acoustic vibration plate is arranged in the center of the flexible film, this may be called "center plate scheme."

In the speaker body 100 according to the center plate scheme, the voice coil 124 is made to vibrate by causing one end portion of the voice coil 124 to directly contact the flexible film.

EXAMPLES

Example 1

Figure 18:
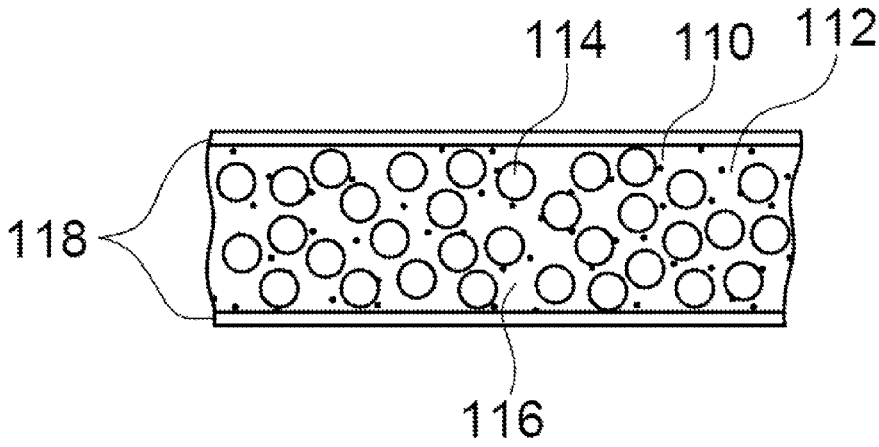
FIG. 18 is a conceptual diagram of a carbonaceous acoustic vibration plate having a low-density layer and a high-density layer according to an example of the present invention.

Example with Three Layers Covering Both Sides of Low-Density Layer with High-Density Layer Polyvinyl chloride resin of 35 mass % and carbon nanofibers of 1.4 mass % having an average grain diameter of 0.1 μm and a length of 5 μm as amorphous carbon source and PMMA as a pore opening member to form pores were mixed together to form a composition and diallyl phthalate monomer as a plasticizer was added to this composition, the composition was then dispersed using a Henschel mixer, kneaded repeatedly a sufficient number of times using a pressure kneader to obtain a kneaded composition, which was then pelletized using a pelletizer to obtain a composition for molding. The pellet of this composition for molding was transformed into a sheet-like molded product having a thickness of 400 μm through extrusion molding, both sides of which were coated with furan resin and hardened to be transformed into a multilayered sheet. This multilayered sheet was processed for 5 hours in an air oven at 200° C. to be a carbon precursor. The multilayered sheet was then heated in a nitrogen gas at a temperature rising rate of 20° C./h and left for three hours at 1000° C. The multilayered sheet was naturally cooled and then kept under a vacuum at 1400° C. for three hours, naturally cooled and carbonization was thus completed. Thus, as conceptually shown in FIG. 18, an acoustic vibration plate was obtained which contains a low-density layer 116 of a porous material having spherical pores 114 remaining after PMMA grains disappear with carbon nanofiber powder 112 uniformly dispersed in amorphous carbon 110 and high-density layers 118 made of the amorphous carbon 110 covering both sides thereof.

The porosity of the low-density layer 116 of the acoustic vibration plate obtained in this way was 70%, the number average pore diameter was 60 μm. The vibration plate as a whole showed excellent properties having a thickness of approximately 350 μm, a bending strength of 25 MPa, Young's modulus of 8 GPa, sound velocity of 4200 m/sec, a density of 0.45 g/cm$^3$ and hygroscopic property of 1 mass % or below.

Figure 19:
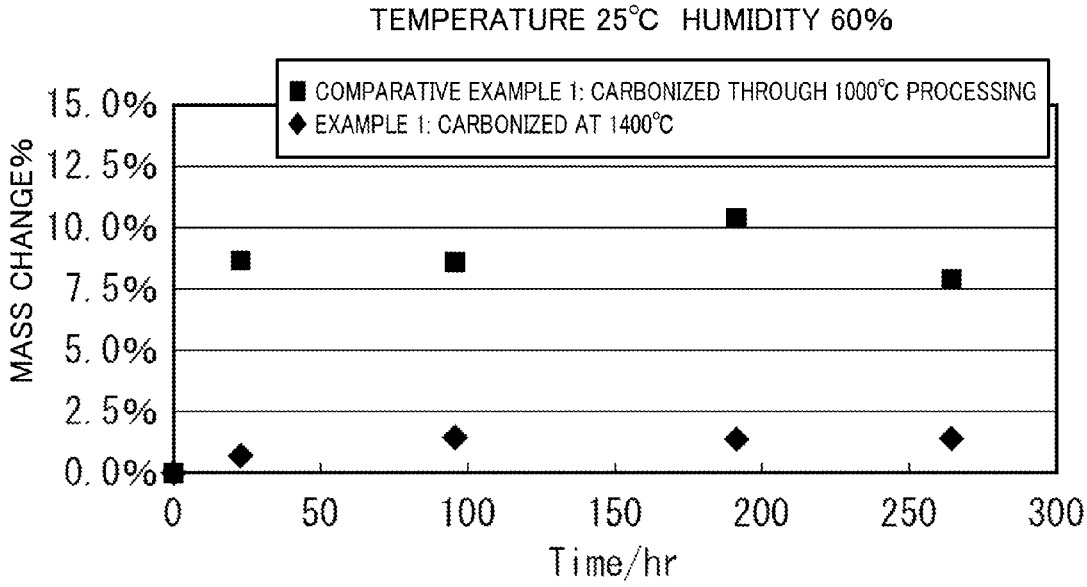
FIG. 19 is a characteristic diagram of the carbonaceous acoustic vibration plate showing a relationship between an elapsed time and mass change according to the example of the present invention.

The velocity of sound was calculated from the density and the measured value of Young's modulus (the same will apply hereinafter). The hygroscopic property is mass increase (%) when the vibration plate was dried for 30 minutes at 100° C. and then left in an environment of temperature 25° C. and humidity 60%. FIG. 19 shows the relationship between the elapsed time and mass change. As a comparative example 1, the result when the last carbonization temperature was assumed to be 1000° C. is also shown. As is clear from FIG. 19, assuming the carbonization temperature is 1200° C. or higher, a vibration plate of low hygroscopic property is obtained whose mass increase after 250 hours is 5% or below.

Example 2

Example where High-Density Layer is Filled with Filler (Graphite)

Polyvinyl chloride resin of 35 mass % and carbon nanofibers of 1.4 mass % having an average grain diameter of 0.1 μm and a length of 5 μm as amorphous carbon source and PMMA as a pore opening member to form pores were mixed together to form a composition and diallyl phthalate monomer as a plasticizer was added to this composition, the composition was then dispersed using a Henschel mixer, kneaded repeatedly a sufficient number of times using a pressure kneader to obtain a kneaded composition, which was then pelletized using a pelletizer to obtain a composition for molding. The pellet of this composition for molding was transformed into a sheet-like molded product having a thickness of 400 μm through extrusion molding, further graphite (SP270 manufactured by Nippon Graphite industries, ltd.) of 5 mass % and having an average grain diameter of on the order of 4 μm was dispersed on furan resin, both sides of which were coated with a liquid containing a hardener and hardened to be transformed into a multilayered sheet. The multilayered sheet was processed in an air oven of 200° C. for five hours to be a carbon precursor. The multilayered sheet was then heated in a nitrogen gas at a temperature rising rate of 20° C./h and left for three hours at 1000° C. The multilayered sheet was naturally cooled and then kept under a vacuum at 1500° C. for three hours, naturally cooled, carbonization completed and a composite carbon vibration plate was thus obtained.

The porosity of the low-density layer of the acoustic vibration plate obtained in this way was 70%, the number average pore diameter was 60 μm. The vibration plate as a whole showed excellent properties having a thickness of approximately 350 μm, a bending strength of 23 MPa, Young's modulus of 5 GPa, sound velocity of 3333 m/sec and a density of 0.45 g/cm$^3$.

Example 3

Example with Only Porous Material

Polyvinyl chloride resin of 54 mass % and carbon nanofibers of 1.4 mass % having an average grain diameter of 0.1

μm and a length of 5 μm as single-layer molded amorphous carbon source having a porosity of 50% and PMMA as a pore opening member to form pores were mixed together to form a composition and diallyl phthalate monomer as a plasticizer was added to this composition, the composition was then dispersed using a Henschel mixer, kneaded repeatedly a sufficient number of times using a pressure kneader to obtain a kneaded composition, which was then pelletized using a pelletizer to obtain a composition for molding. This pellet was used to perform extrusion molding for a film-like molded product having a thickness of 400 μm through extrusion molding. This film was processed in an air oven heated to 200° C. for five hours to be a carbon precursor. The film was then heated in a nitrogen gas at a temperature rising rate of 20° C./h and left for three hours at 1000° C. The film was naturally cooled and then kept under a vacuum at 1500° C. for three hours, naturally cooled, carbonization completed and a composite carbon vibration plate was thus obtained.

The porous acoustic vibration plate obtained in this way showed excellent properties having a porosity of 50%, a pore diameter of 60 μm, a thickness of approximately 350 μm, a bending strength of 29 MPa, Young's modulus of 7 GPa, sound velocity of 3055 m/sec and a density of 0.75 g/cm$^3$.

Next, the frequency characteristic of a speaker using the vibration plate created in Example 1 above for the aforementioned digital speaker unit will be described. The voice coil 24 provided for the digital speaker unit is made up of six voice coils, the delta-sigma modulator 11 converts a 16-bit digital audio signal to a 4-bit signal and the thermometer code outputted from the thermometer code conversion section 12 is assumed to have a 6-bit configuration.

Figure 20:
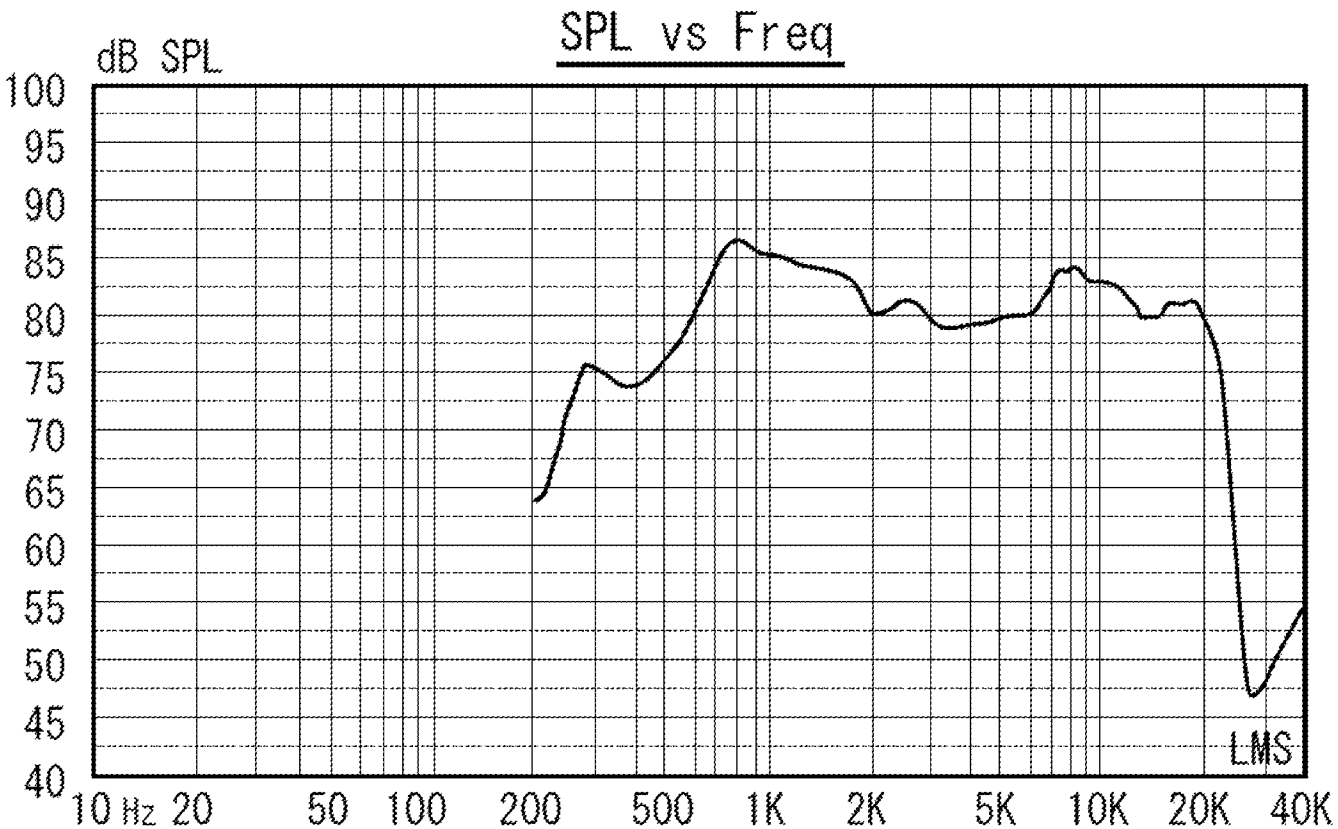
FIG. 20 is a frequency characteristic diagram of the digital speaker using only the carbonaceous acoustic vibration plate according to the example of the present invention.

FIG. 20 shows the frequency characteristic when the vibration plate obtained in Example 1 is used. As shown in the same figure, in the case of only the carbonaceous vibration plate, a very flat characteristic from close to 700 Hz to 20 kHz which is said to be an upper limit of the audible frequency band has been realized. With the frequency characteristic shown in FIG. 20, extremely high sound quality can be realized. Furthermore, a peak sound pressure of 85 dBspl or more has been realized.

As described above, the digital speaker unit according to an embodiment of the present invention can realize excellent acoustic characteristics by directly driving, with a digital audio signal, a carbonaceous acoustic vibration plate which has a low density and light weight, yet sufficient rigidity.

The present application is based on Japanese Patent Application No. 2009-057901 filed on Mar. 11, 2009 and Japanese Patent Application No. 2009-111539 filed on Apr. 30, 2009, entire content of which is expressly incorporated by reference herein.

The invention claimed is:

1. A speaker unit comprising:

a carbonaceous acoustic vibration plate;

a voice coil made up of a cylindrically wound conductive wire, one open end portion of which is fixed in direct contact with the carbonaceous acoustic vibration plate;

magnetic flux generating section configured to generate a magnetic flux that penetrates the cylindrical voice coil in a diameter direction; and drive section configured to supply a drive current corresponding to an audio signal to the voice coil, wherein the voice coil is made up of a plurality of unit voice coils corresponding to the number of bits of the digital signal configured by making the plurality of unit voice coils have different diameters and sequentially inserting the unit voice coils such that a unit voice coil of a smaller diameter is inserted into a unit voice coil of a greater diameter, and the drive section individually drives the each unit voice coil based on each bit value of the digital signal.

2. The speaker unit according to claim 1, wherein:

the each unit voice coil is configured by cylindrically winding a conductive wire having an oblong cross section such that wires neighboring each other in a direction orthogonal to the coil diameter direction are in close contact with each other in the major axis direction of the wire cross section.

3. The speaker unit according to claim 1, wherein:

the each unit voice coil is configured by cylindrically winding a conductive wire having an oblong cross section such that wires neighboring each other in a direction orthogonal to the coil diameter direction are in close contact with each other in the minor axis direction of the wire cross section.

4. The speaker unit according to claim 1, wherein:

the carbonaceous acoustic vibration plate comprises a first principal surface to which an open end portion of the voice coil is fixed and a second principal surface opposite to the first principal surface, and the voice coil is arranged so that an outermost circumference position of the open end portion is located at a position deviated inward from the vibration plate outer circumferential edge and one end portion of a support member that supports the carbonaceous acoustic vibration plate in a vibratable manner on the vibration plate outer circumferential edge which is on the second principal surface and does not overlap the fixed position of the open end portion of the voice coil.

5. The speaker unit according to claim 1, wherein:

the magnetic flux generating section comprises a yoke having an end portion facing an outer circumferential surface of the voice coil fixed to the carbonaceous acoustic vibration plate, a centerpiece, inserted into the coil from the other open end portion of the voice coil, that forms a gap between opposed end portions of the yoke and itself, and a permanent magnet located between the centerpiece and the yoke, one magnetic pole of which is faced on the centerpiece side and the other magnetic pole of which is faced on the yoke side, and the carbonaceous acoustic vibration plate comprises a first principal surface to which an open end portion of the voice coil is fixed, a second principal surface provided opposite to the first principal surface and a convex portion formed at a position at which the open end portion of the voice coil is fixed on the first principal surface wherein the convex portion has a height that a central portion of the voice coil becomes a gap position between the end portion of the yoke and the centerpiece.

6. The speaker unit according to claim 1, wherein:

lead positions of lead wires connected to the respective unit voice coils are distributed uniformly on the outer circumference of the carbonaceous acoustic vibration plate.

7. The speaker unit according to claim 1, wherein:

the drive section comprises a delta-sigma modulator that delta-sigma modulates a multi-value bit digital audio signal supplied from a digital sound source and individually drives the each voice coil based on the digital signal outputted from the delta-sigma modulator.

8. The speaker unit according to claim 7, wherein:

the drive section comprises a thermometer code conversion section that converts a digital signal with predetermined bits outputted from the delta-sigma modulator to a thermometer code with bits corresponding to the number of the voice coils.

9. The speaker unit according to claim 1, wherein:

the carbonaceous acoustic vibration plate is made of a porous material containing amorphous carbon and carbon powder uniformly dispersed in the amorphous carbon and having a porosity of 40% or above.

10. The speaker unit according to claim 1, wherein:

the carbonaceous acoustic vibration plate comprises a low-density layer containing amorphous carbon and carbon powder uniformly dispersed in the amorphous carbon and made of a porous material having a porosity of 40% or above, and a high-density layer which contains amorphous carbon, is thinner than the low-density layer and has a higher density than the low-density layer.

11. The speaker unit according to claim 1, wherein:

the speaker body makes the voice coil vibrate in contact with the carbonaceous acoustic vibration plate.

12. The speaker unit according to claim 1, wherein:

the carbonaceous acoustic vibration plate is supported by a flexible film and the voice coil is made vibrate in contact with the film.

* * * * *

UNITED STATES PATENT AND TRADEMARK OFFICE

CERTIFICATE OF CORRECTION

PATENT NO. : 8,687,838 B2
APPLICATION NO. : 13/255754
DATED : April 1, 2014
INVENTOR(S) : Mitsui et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 245 days.

Signed and Sealed this
Twenty-ninth Day of September, 2015

Michelle K. Lee

Michelle K. Lee
*Director of the United States Patent and Trademark Office*